US009004643B2

(12) United States Patent
Ito

(10) Patent No.: US 9,004,643 B2
(45) Date of Patent: Apr. 14, 2015

(54) LIQUID EJECTION APPARATUS

(71) Applicant: Brother Kogyo Kabushiki Kaisha, Nagoya-shi, Aichi-ken (JP)

(72) Inventor: Takashi Ito, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 70 days.

(21) Appl. No.: 13/739,658

(22) Filed: Jan. 11, 2013

(65) Prior Publication Data

US 2013/0182033 A1 Jul. 18, 2013

(30) Foreign Application Priority Data

Jan. 13, 2012 (JP) ..... 2012-005543

(51) Int. Cl.
*B41J 2/165* (2006.01)
*B41J 2/21* (2006.01)

(52) U.S. Cl.
CPC ..... *B41J 2/1652* (2013.01); *B41J 2/16505* (2013.01); *B41J 2/16526* (2013.01); *B41J 2/2146* (2013.01)

(58) Field of Classification Search
CPC .. B41J 2/1652; B41J 2/16526; B41J 2/16579; B41J 2/16532; B41J 2/16523; B41J 2/16547; B41J 2/16508
See application file for complete search history.

(56) References Cited

U.S. PATENT DOCUMENTS 6,312,092 B1 * 11/2001 Usui et al. ..... 347/30
7,300,134 B2 * 11/2007 Suzuki ..... 347/29
2004/0160475 A1 8/2004 Satoh et al.
2010/0033539 A1 * 2/2010 Silverbrook et al. ..... 347/61
2011/0109689 A1 5/2011 Sugimoto et al.
2011/0242204 A1 10/2011 Shinoda
2011/0316942 A1 12/2011 Koyama
2012/0194604 A1 * 8/2012 Tamaki et al. ..... 347/22
2012/0206537 A1 * 8/2012 Nukui et al. ..... 347/32
2013/0182033 A1 7/2013 Ito
2013/0182034 A1 7/2013 Ito
2013/0182035 A1 7/2013 Ito

FOREIGN PATENT DOCUMENTS

JP 2011-098521 A 5/2011
JP 2011-207091 A 10/2011

OTHER PUBLICATIONS

Office Action issued in U.S. Appl. No. 13/739,845 dated Jan. 2, 2014.
Office Action issued in U.S. Appl. No. 13/739,845 dated Sep. 9, 2013.

* cited by examiner

*Primary Examiner* — Manish S Shah
*Assistant Examiner* — Jeremy Delozier
(74) *Attorney, Agent, or Firm* — Merchant & Gould PC

(57) ABSTRACT

A liquid ejection apparatus includes: a head including an ejection face inclining an ejection opening region having ejection openings; a capping unit for selectively establishing a sealing state or an open state; an air supply opening and an air discharge opening; a humidification unit for performing a humidifying maintenance; a recording control unit for performing image recording; and a flushing control unit for performing flushing. The flushing control unit controls the head to perform the flushing such that an amount of the liquid discharged from each of a discharge-side ejection-opening group and a supply-side ejection-opening group is greater than that of the liquid discharged from the other ejection-opening group.

15 Claims, 10 Drawing Sheets

FIG.8A

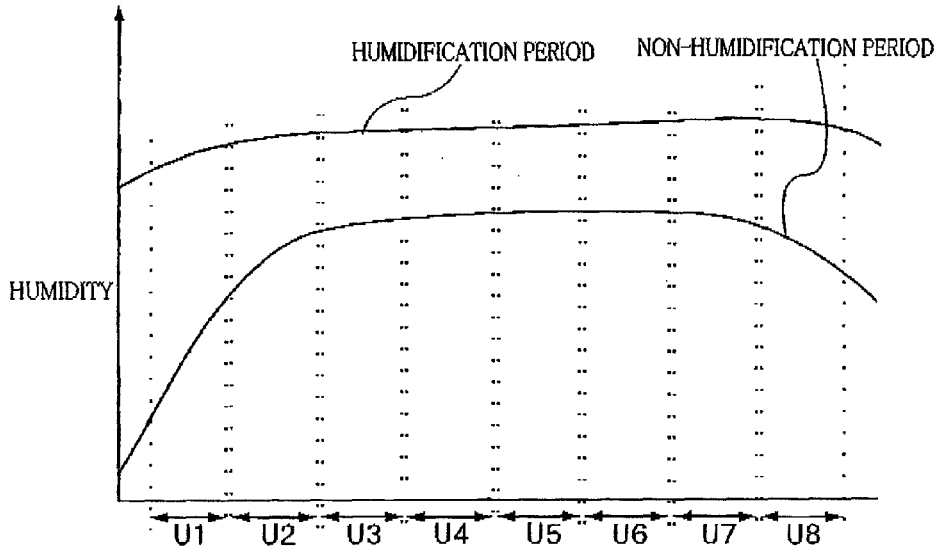

FIG.8B

ADDITIVE EJECTION NUMBER PER HOUR IN HUMIDIFYING PERIOD

| EJECTION-OPENING GROUP | U1 | U2 | U3 | U4 | U5 | U6 | U7 | U8 |
|---|---|---|---|---|---|---|---|---|
| ADDITIVE EJECTION NUMBER | 120 | 90 | 80 | 70 | 60 | 50 | 40 | 50 |

FIG.8C

ADDITIVE EJECTION NUMBER PER HOUR IN NON-HUMIDIFYING PERIOD

| EJECTION-OPENING GROUP | U1 | U2 | U3 | U4 | U5 | U6 | U7 | U8 |
|---|---|---|---|---|---|---|---|---|
| ADDITIVE EJECTION NUMBER | 300 | 250 | 180 | 160 | 150 | 160 | 170 | 200 |

FIG.8D

PERIOD ADDITIVE EJECTION NUMBER

| EJECTION-OPENING GROUP | U1 | U2 | U3 | U4 | U5 | U6 | U7 | U8 |
|---|---|---|---|---|---|---|---|---|
| ADDITIVE EJECTION NUMBER | 3120 | 2590 | 1880 | 1670 | 1560 | 1650 | 1740 | 2050 |

FIG.8E

ADDITIVE CORRECTION NUMBER

| EJECTION-OPENING GROUP | U1 | U2 | U3 | U4 | U5 | U6 | U7 | U8 |
|---|---|---|---|---|---|---|---|---|
| ADDITIVE EJECTION NUMBER | 3120 | 2590 | 880 | 670 | 560 | 650 | 740 | 2050 |

FIG.8F

FLUSHING EJECTION NUMBER AFTER ADDITIVE CORRECTION

| EJECTION-OPENING GROUP | U1 | U2 | U3 | U4 | U5 | U6 | U7 | U8 |
|---|---|---|---|---|---|---|---|---|
| EJECTION NUMBER | 4120 | 3590 | 1880 | 1670 | 1560 | 1650 | 1740 | 3050 |

LIQUID EJECTION APPARATUS

CROSS REFERENCE TO RELATED APPLICATION

The present application claims priority from Japanese Patent Application No. 2012-005543, which was filed on Jan. 13, 2012, the disclosure of which is herein incorporated by reference in its entirety.

BACKGROUND OF THE INVENTION

1. Field of the Invention

The present invention relates to a liquid ejection apparatus configured to eject liquid such as ink.

2. Description of the Related Art

An ink-jet printer as one example of a liquid ejection apparatus includes a head having an ejection face that has a multiplicity of ejection openings through which the head ejects ink onto a recording medium to record an image on the recording medium. Here, when a relatively long time has passed with no liquid ejected from these ejection openings, viscosity of the liquid near the ejection openings increases due to drying, which may cause clogging of the ejection openings. The following technique is known as a technique for suppressing the clogging of the ejection openings, for example.

In this technique, capping is performed by covering the ejection face with a cap to form an ejection space isolated from an outside space. Air in the ejection space is humidified by a humidifying mechanism including a circulation channel that has one end and the other end opening in the ejection space. Specifically, the humidifying mechanism humidifies the air in the ejection space by collecting the air from the ejection space through an opening or an air discharge opening formed at the one end and by supplying humid air into the ejection space through an opening or an air supply opening formed at the other end. This humidification reduces an amount of liquid vaporized near the ejection openings, thereby suppressing the clogging of the ejection openings.

SUMMARY OF THE INVENTION

Incidentally, when using the head, the liquid is ejected or discharged from all the ejection openings, that is, flushing (specifically, before-use flushing) is performed to recover ejection characteristics of all the ejection openings. Here, the present inventor has found that humidity distribution in the ejection space is not uniform in the capping, and accordingly drying degrees in the ejection openings per unit time vary according to their respective positions. Thus, if the same amount of ink is ejected from all of the ejection openings in the before-use flushing, the amount of the ink has to be determined based on the ejection opening in which viscosity of the ink is high, resulting in unnecessary consumption of the ink.

This invention has been developed to provide a liquid ejection apparatus capable of reducing consumption of liquid in before-use flushing.

The present invention provides a liquid ejection apparatus, comprising: a head comprising an ejection face that comprises an ejection opening region having a plurality of ejection openings through which the head ejects liquid to record an image on a recording medium; a capping unit configured to selectively establish one of: a sealing state in which an ejection space opposed to the ejection face is isolated from an outside space; and an open state in which the ejection space is open to the outside space; an air supply opening and an air discharge opening communicating with the ejection space in the sealing state and arranged such that the ejection opening region is interposed between the air supply opening and the air discharge opening when seen in a direction perpendicular to the ejection face; a humidification unit configured to perform a humidifying maintenance in the sealing state by supplying humid air into the ejection space via the air supply opening and by discharging air from the ejection space via the air discharge opening; a recording control unit configured to control the head to perform image recording by ejecting the liquid from at least one of the plurality of ejection openings which is opposed to the recording medium; and a flushing control unit configured to control the head to perform flushing by ejecting the liquid from at least one of the plurality of ejection openings after the sealing state and before the image recording, wherein the plurality of ejection openings are divided into a plurality of ejection-opening groups in a direction directed from the air supply opening toward the air discharge opening, the plurality of ejection-opening groups each being constituted by at least one of the plurality of ejection openings, wherein the plurality of ejection-opening groups comprise: a discharge-side ejection-opening group containing at least one of the plurality of ejection openings which is located within a first distance from the air discharge opening; a supply-side ejection-opening group containing at least one of the plurality of ejection openings which is located within a second distance from the air supply opening; and an other ejection-opening group that is at least one ejection-opening group different from the discharge-side ejection-opening group and the supply-side ejection-opening group among the plurality of ejection-opening groups, and wherein the flushing control unit is configured to control the head to perform the flushing such that an amount of the liquid discharged from each of the discharge-side ejection-opening group and the supply-side ejection-opening group is greater than an amount of the liquid discharged from the other ejection-opening group.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which:

FIG. 8A is a view generally representing a humidity distribution in an ejection space near the ejection face in a capping operation, FIG. 8B is a table representing additive correction numbers for flushing in a humidifying period, FIG. 8C is a table representing additive correction numbers for the flushing in a non-humidifying period, FIG. 8D is a table representing period additive ejection numbers, FIG. 8E is a table representing additive correction numbers which are added to the reference ejection number stored in a flushing-amount storage section, and FIG. 8F is a table representing the number of ejections in flushing (flushing ejection number) stored in the flushing-amount storage section after the correction by a flushing-amount correcting section;

DETAILED DESCRIPTION OF THE EMBODIMENT

Hereinafter, there will be described one embodiment of the present invention by reference to the drawings.

Figure 1:
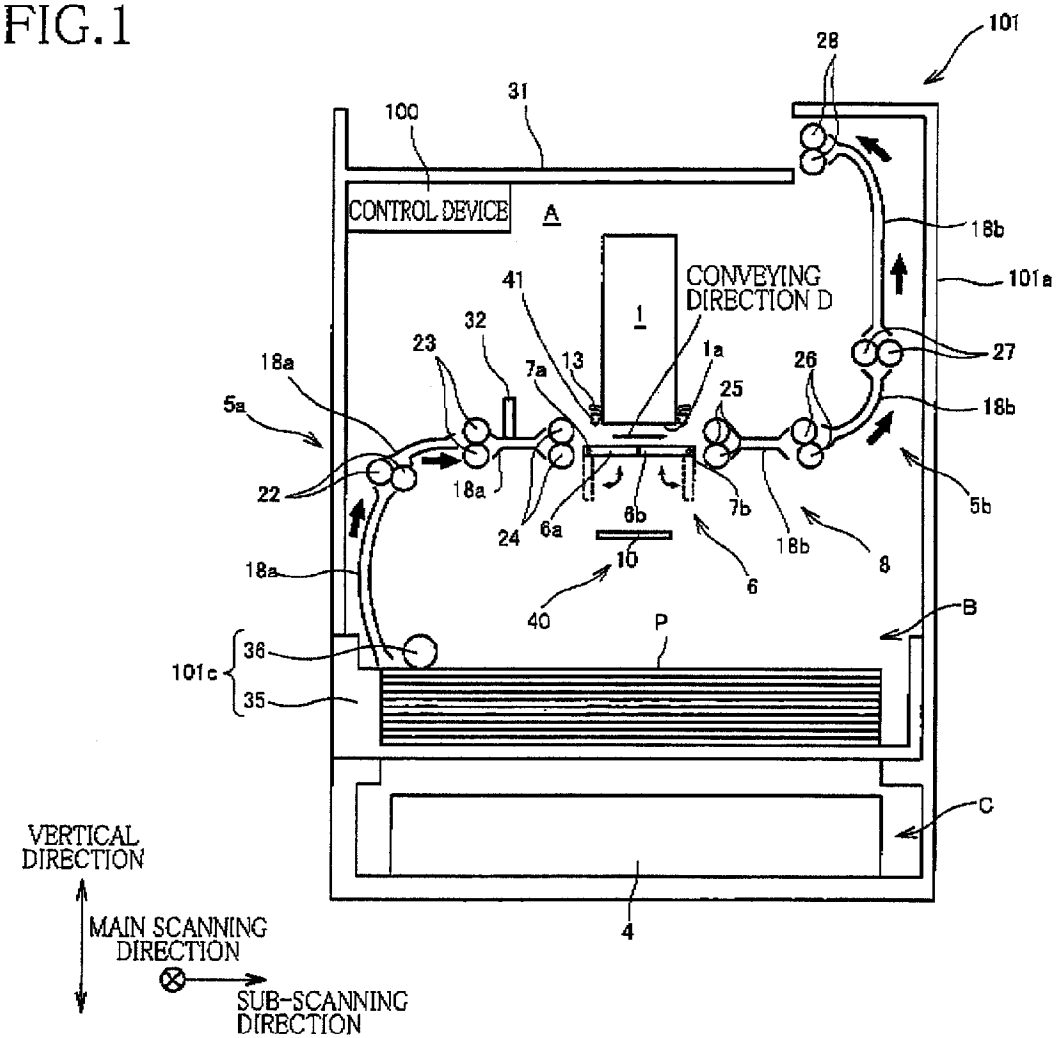
FIG. 1 is a side view generally illustrating an internal structure of an ink-jet printer as a liquid ejection apparatus according to one embodiment of the present invention.

First, there will be explained, with reference to FIG. 1, an overall structure of an ink-jet printer 101 as one example of a liquid ejection apparatus according to one embodiment of the present invention.

The printer 101 includes a housing 101*a* having a rectangular parallelepiped shape. Provided on a top plate of the housing 101*a* is a sheet-discharge portion 31 onto which a recording medium in the form of a sheet P is discharged. An inner space of the housing 101*a* is divided into spaces A, B, and C in order from an upper side thereof. In the spaces A and B is formed a sheet conveyance path extending from a sheet-supply unit 101*c* to the sheet-discharge portion 31. The sheet P is conveyed through this sheet conveyance path along bold arrows indicated in FIG. 1. In the space A, an image is formed or recorded on the sheet P, and the sheet P is conveyed to the sheet-discharge portion 31. In the space B, the sheet P is supplied to the sheet conveyance path. In the space C is provided a cartridge 4 that supplies ink to an ink-jet head 1 (hereinafter referred 10 as "head 1") in the space A.

Components arranged in the space A include: the head 1 configured to eject black ink; a guide mechanism 8; a capping mechanism 40 as one example of a capping unit; a sheet sensor 32; a humidifying mechanism 50 (see FIG. 6) used for a humidifying maintenance; a head elevating and lowering mechanism 30 (see FIG. 9); a wiper mechanism 70 (see FIG. 3) used for a wiping operation, i.e., wiping; and a control device 100.

The head 1 has a generally rectangular parallelepiped shape elongated in a main scanning direction. The head 1 is supported by a housing 101*a* via a head holder 13 and configured to eject liquid droplets of the black ink. A lower face of the head 1 is an ejection face 1*a* having a multiplicity of ejection openings 108 (see FIGS. 2B and 4A) opening therein. The head holder 13 supports the head 1 such that a space appropriate for the image recording is formed between the ejection face 1*a* of the head 1 and a support portion 6 including platens 6*a*, 6*b*.

In addition to the head 1, a cap member 41 of the capping mechanism 40 is attached to the head holder 13. The cap member 41 is an enclosing member provided on a periphery of the head 1 so as to enclose the head 1 in plan view. The head 1 and the capping mechanism 40 will be explained later in detail.

The guide mechanism 8 defining the sheet conveyance path includes: two guide portions 5*a*, 5*b* for guiding the sheet P; and the support portion 6 configured to support a lower face of the sheet P conveyed for the image recording. The two guide portions 5*a*, 5*b* are arranged such that the support portion 6 is interposed therebetween, with the guide portion 5*a* located upstream of the guide portion 5*b* in a conveying direction. The guide portion 5*a* includes the three guides 18*a* and three conveyor roller pairs 22-24. The guide portion 5*a* connects between the sheet-supply unit 101*c* and the platens 6*a*, 6*b* and conveys the sheet P to the platens 6*a*, 6*b* for the image recording.

The guide portion 5*b* includes three guides 18*b* and four conveyor roller pairs 25-28. The guide portion 5*b* connects between the platens 6*a*, 6*b* and the sheet-discharge portion 31 and conveys the sheet P toward the sheet-discharge portion 31 after the image recording. Here, a sub-scanning direction is a direction parallel to a conveying direction D which is indicated by arrow D in FIG. 1 and in which the sheet P is conveyed by the conveyor roller pairs 24, 25, while a main scanning direction is a conveyance perpendicular direction which is parallel to the ejection face 1*a* and perpendicular to the conveying direction D.

The support portion 6 includes the two platens 6*a*, 6*b* and a drive motor, not shown, for pivoting these platens 6*a*, 6*b*. The two platens 6*a*, 6*b* are arranged in this order in the conveying direction and respectively include pivotal shafts 7*a*, 7*b* extending in the main scanning direction. The upstream-side platen 6*a* is pivotable about an upstream end thereof, while the downstream-side platen 6*b* is pivotable about a downstream end thereof. When the control device 100 drives the drive motor, the two platens 6*a*, 6*b* are pivoted between a support-face forming position and an open position. At the support-face forming position indicated by solid lines in FIG. 1, the two platens 6*a*, 6*b* extend horizontally with their distal ends facing each other, so that the two platens 6*a*, 6*b* constitute a flat support face as a whole. At the open position indicated by broken lines in FIG. 1, the two platens 6*a*, 6*b* are pivoted 90 degrees so as to extend downward, so that their upper faces are parallel to each other. As a result, the head 1 (specifically, the ejection face 1*a*) directly faces a facing member 10 with a space therebetween. It is noted that the two platens 6*a*, 6*b* are located at the support-face forming position normally and located at the open position in maintenances.

The sheet sensor 32 is disposed upstream of the conveyor roller pair 24 to sense a leading edge of the sheet P. Upon the sense of the sheet P, the sheet sensor 32 outputs a sense signal that is used for driving the head 1 and the conveyor roller pairs 22-28 to form an image in desired resolution and at a desired speed.

The humidifying mechanism 50 is designed to supply humid air into an ejection space S1 that is opposed to the ejection face 1*a*. The ink in the ejection openings 108 opening in the ejection face 1*a* is replenished with water (that is, water is supplied to the ink in the ejection openings 108), which suppresses an increase in viscosity (i.e., thickening) and drying of the ink. The humidifying mechanism 50 will be explained later in detail.

The head elevating and lowering mechanism 30 selectively elevates or lowers the head holder 13 to move the head 1 selectively to one of a recording position, a separated position (or an upper position), and a wiping position. At the recording position, as shown in FIG. 1, the head 1 is opposed to the platens 6*a*, 6*b* at a distance appropriate for the image recording. At the separated position, the head 1 is located above the recording position and far from the platens 6*a*, 6*b* (see FIG. 3C). At the wiping position, the head 1 is located between the recording position and the separated position (see FIG. 3B). At the wiping position and the separated position, wipers 71*a*, 71*b* which will be described below are movable in a space formed between the head 1 and the facing member 10.

As shown in FIG. 3, the wiper mechanism 70 includes: the two wipers 71*a*, 71*b*; a base portion 71*c* for supporting these wipers 71*a*, 71*b*; and a wiper moving mechanism 75. The wiper 71*a* is provided so as to extend upward from an upper face of the base portion 71*c* in a vertical direction, while the wiper 71*b* is provided so as to extend downward from a lower face of the base portion 71*c* in the vertical direction. Each of these wipers 71*a*, 71*b* is an elastic plate member formed of rubber, for example. The wiper 71*a* is slightly longer in width than the ejection face 1*a*, and the wiper 71*b* is slightly longer in width than the facing member 10. The base portion 71*c* has a rectangular parallelepiped shape elongated in the sub-scanning direction as a longitudinal direction and has holes respectively formed in its opposite end portions. These holes are formed through the base portion 71*c* in the main scanning direction, and a female thread is formed in an inner face of one of the holes.

The wiper moving mechanism 75 is constituted by a pair of guides (e.g., round rods) 76 and a drive motor, not shown. A male thread is formed in an outer circumferential face of one of the guides 76 which receives a rotational power from the drive motor. This guide 76 is fitted through the one hole such that its male thread is engaged with the female thread of the hole. The other of the guides 76 is provided through the other of the holes such that the guide 76 is slidable on an inner circumferential face of the hole in the main scanning direction. The pair of guides 76 extend along side faces of the head 1 such that the head 1 located at the recording position is interposed between the guides 76 in the sub-scanning direction.

Figure 3A:
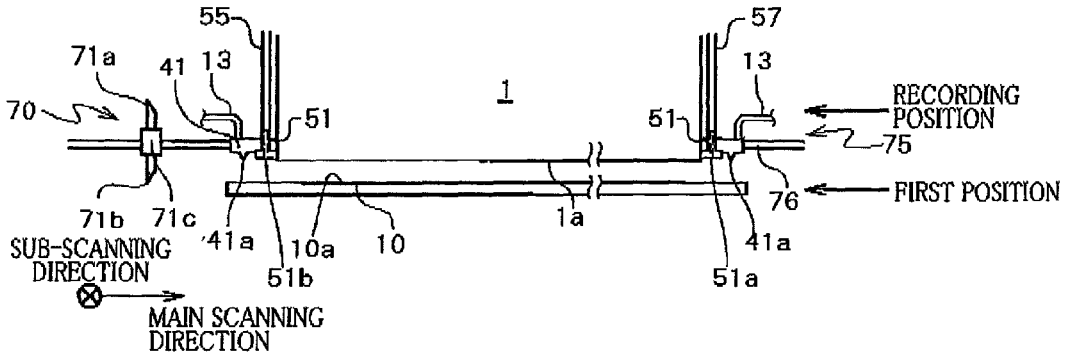
FIGS. 3A-3C are views for explaining situations during operations of wiping.

Forward and reverse rotations of the drive motor reciprocate the base portion 71*c* along the guides 76. As shown in FIG. 3A, a position near a left end portion of the head 1 in the main scanning direction is a wait position of the base portion 71*c*. In first wiping, the base portion 71*c* is moved in the main scanning direction, i.e., a right direction in FIGS. 3A-3C, with the wiper 71*a* being held in contact with the ejection face 1*a*, whereby the wiper 71*a* is moved relative to the ejection face 1*a* to wipe foreign matters off the ejection face 1*a*. In second wiping, the base portion 71*c* is moved in the main scanning direction, i.e., the right direction in FIGS. 3A-3C, with the wiper 71*b* being held in contact with a face 10*a* of the facing member 10, whereby the wiper 71*a* is moved relative to the face 10*a* to wipe foreign matters off the face 10*a*. The base portion 71*c* is returned to the wait position after the head 1 is moved to the separated position, and the facing member 10 is moved to a fourth position which will be described below.

The sheet-supply unit 101*c* is disposed in the space B. The sheet-supply unit 101*c* includes a sheet-supply tray 35 and a sheet-supply roller 36. The sheet-supply tray 35 is mountable on and removable from the housing 101*a*. The sheet-supply tray 35 has a box shape opening upward and can accommodate a plurality of the sheets P. The sheet-supply roller 36 is rotatable to supply an uppermost one of the sheets P accommodated in the sheet-supply tray 35.

Attached to the sheet-supply tray 35 is a slidable sheet limiting mechanism, not shown, which allows the sheet-supply tray 35 to accommodate the sheets P of various sizes whose widths differ from one another in the main scanning direction. This sheet limiting mechanism includes: a pair of sheet positioning walls 35*a* (see FIG. 5) which are parallel to each other in the conveying direction. The sheet positioning walls 35*a* are for limiting or restraining each sheet P in the sheet-supply tray 35 such that the position of the sheet P in the main scanning direction is limited to a predetermined reference position. In the present embodiment, the guide mechanism 8 and the sheet-supply unit 101*c* are one example of a conveyor mechanism. The sheet positioning walls 35*a* will be explained later in detail.

The cartridge 4 storing the black ink is disposed in the space C so as to be mountable on and removable from the housing 101*a*. The cartridge 4 is coupled to the head 1 via a tube, not shown, and a pump 38 (see FIG. 9). It is noted that the pump 38 is driven in forcible delivery of the ink to the head 1 (e.g., in purging (i.e., a purging operation) and initial supply of the liquid) and stopped at the other times so as not to inhibit the ink supply to the head 1.

There will be next explained the control device 100. The control device 100 controls the components of the printer 101 to control the operations of the printer 101. The control device 100 controls an image recording operation based on a recording command (e.g., image data) supplied from an external device such as a PC coupled to the printer 101. Upon receipt of the recording command, the control device 100 drives the sheet-supply unit 101*c* and the guide mechanism 8. The sheet P supplied from the sheet-supply tray 35 is conveyed onto the support face of the platens 6*a*, 6*b* while being guided by the upstream guide portion 5*a*. When the sheet P passes through a position just under the head 1 in the sub-scanning direction, i.e., the conveying direction D, the control device 100 controls the head 1 to eject the ink from the ejection openings 108 to record a desired image. It is noted that timings of the ink ejection are determined based on the sense signals supplied from the sheet sensor 32. After the image recording, the sheet P is discharged from an upper portion of the housing 101*a* onto the sheet-discharge portion 31 while being guided by the downstream guide portion 5*b*.

The control device 100 also controls maintenance operations for recovery and maintenance of liquid ejection characteristics of the head 1. The maintenance operations include the purging, a flushing operation or flushing, a wiping operation or wiping, a capping operation or capping, and the humidifying maintenance.

In the purging, the pump 38 is driven to forcibly discharge the ink from all the ejection openings 108. Actuators are not driven in this purging. In the flushing, the actuators are driven to eject the ink from the ejection openings 108. The flushing includes: recording flushing performed in the image recording on the basis of flushing data that is data different from the image data; and before-we flushing (before-recording flushing) performed before the image recording.

The wiping includes: the first wiping for wiping the ejection face 1*a*; and the second wiping for wiping the face 10*a* of the facing member 10. The first wiping is performed after the purging to remove foreign matters such as the ink left on the ejection face 1*a*. The second wiping is performed after the purging and the before-use flushing to remove foreign matters such as the ink left on the face 10*a* of the facing member 10.

Figure 6:
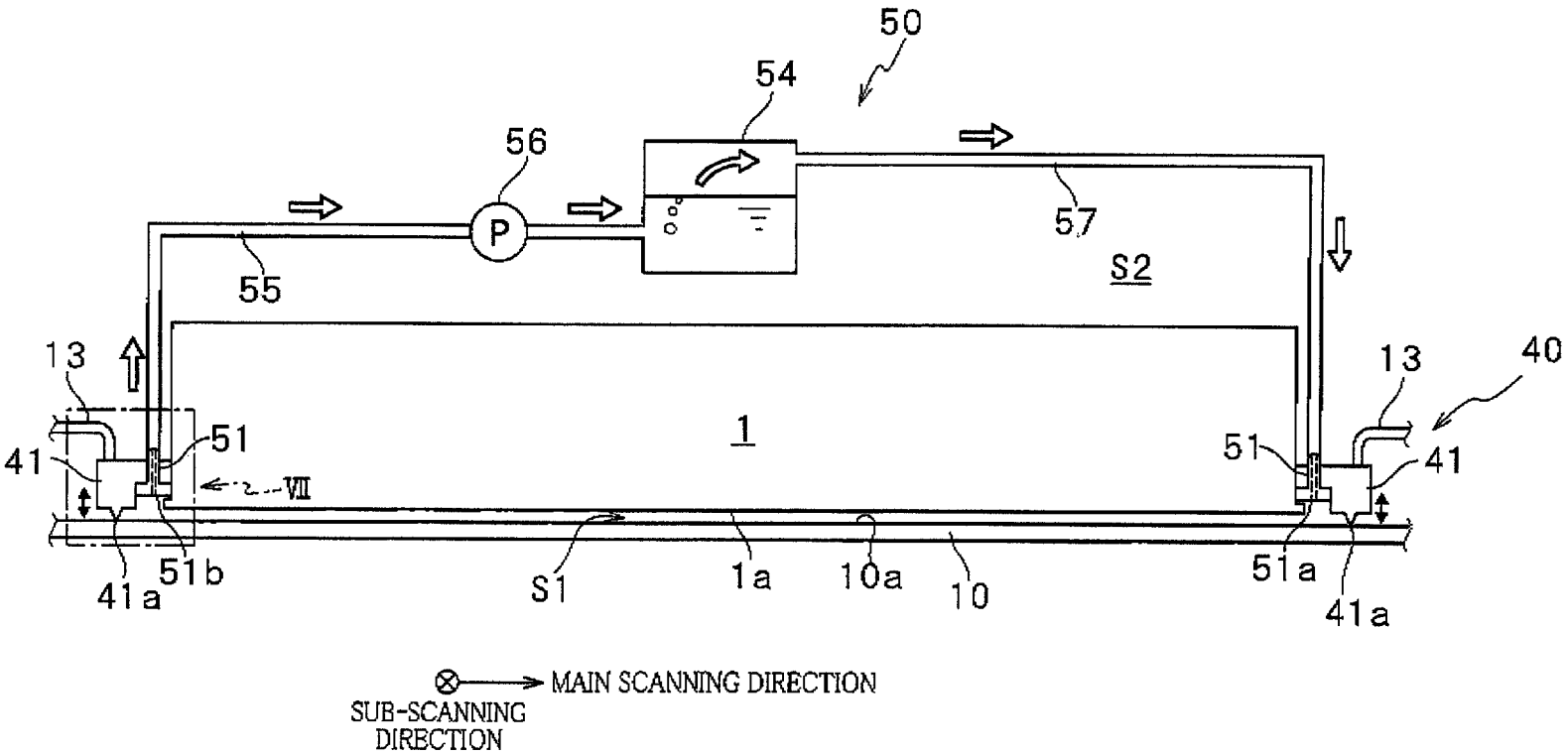
FIG. 6 is a schematic view illustrating a capping mechanism and a humidifying mechanism of the printer in FIG. 1.

In the capping, as shown in FIG. 6, the ejection space S1 that is opposed to the ejection face 1*a*, i.e., the ejection openings 108 is isolated from an outside space S2 by the capping mechanism 40 and changed to a sealing state. A passage for releasing water of the ink in each ejection opening 108 is closed in the capping, which suppresses the increase in viscosity and the drying of the ink. In the humidifying maintenance, as shown in FIG. 6, humid air is supplied into the ejection space S1 being in the sealing state. The humid air supplied into the ejection space S1 further suppresses the drying of the ink in the ejection openings 108. The capping is performed when the head 1 is at rest (e.g., when the image recording is not performed for a set specific period). The humidifying maintenance is performed only for a set specific period in the capping.

Figure 4A:
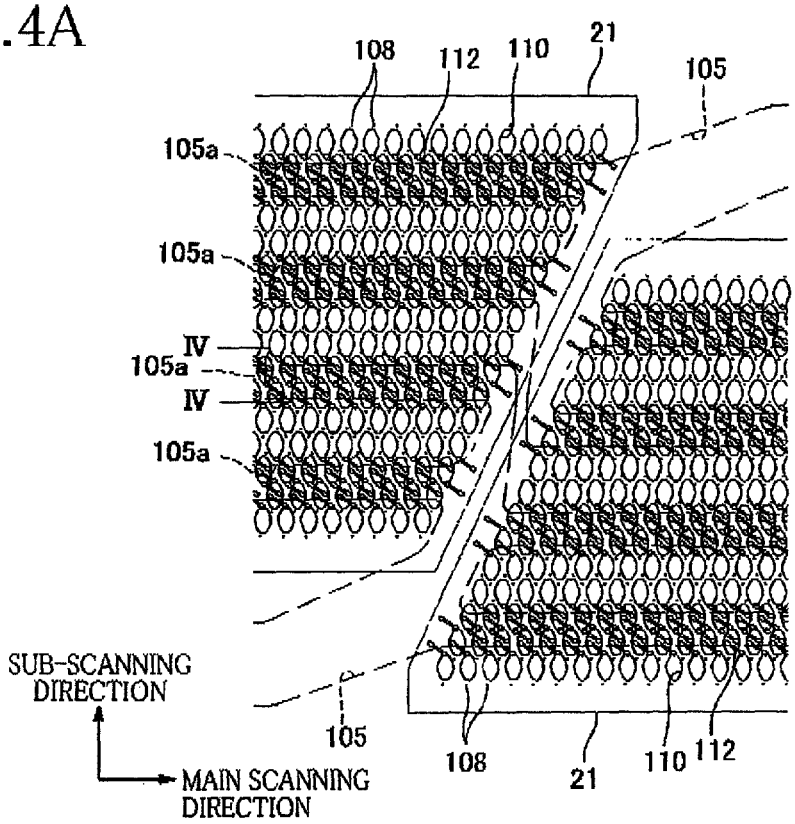
FIG. 4A is an aligned view illustrating an area IV enclosed by a one-dot chain line in FIG. 2A.

There will be next explained the head 1 in detail with reference to FIGS. 2, 4A-4C, and 5. In FIG. 4A, pressure chambers 110, apertures 112, and the ejection openings 108 are illustrated by solid lines for easier understanding purposes though these elements are located under actuator units 21 and thus should be illustrated by broken lines.

Figure 2A:
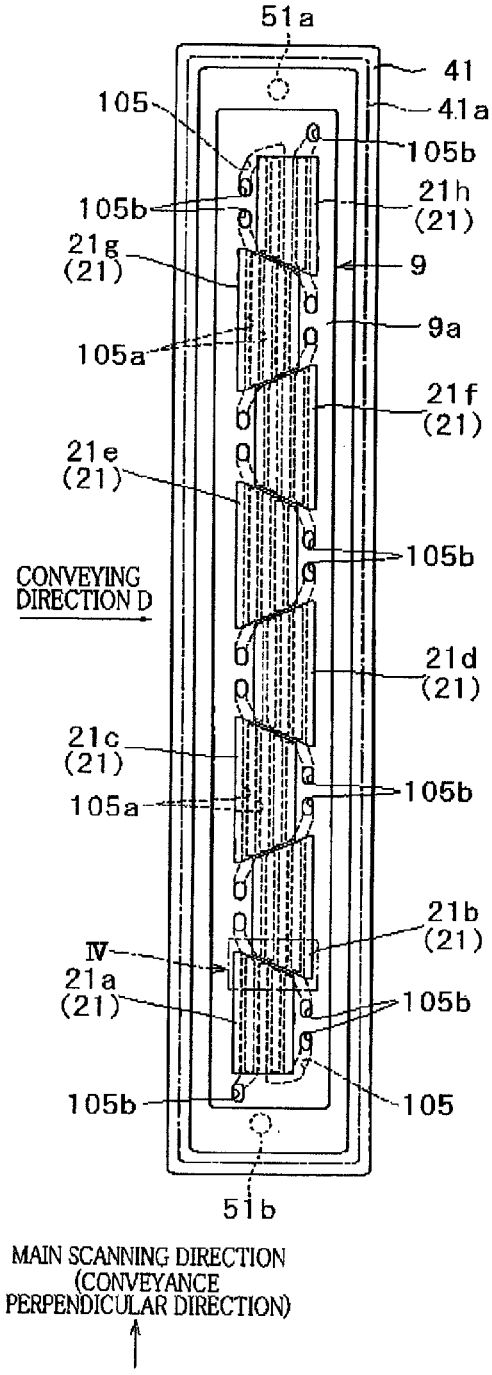
FIG. 2A is a plan view illustrating a channel unit and actuator units of an ink-jet head of the printer in FIG. 1.

As shown in FIG. 2A, the head 1 includes a channel unit 9 and the eight actuator units 21 (21*a*-21*h*) fixed to an upper face 9*a* of the channel unit 9. The actuator units 21 include a plurality of unimorph actuators respectively corresponding to the pressure chambers 110 so as to selectively apply ejection energy to the ink in the pressure chambers 110. Though not shown, the head 1 is a stacked body including: the channel unit 9; a reservoir unit for storing the ink to be supplied to the channel unit 9; a flexible printed circuit (FPC) for supplying drive signals to the actuator units 21; and a circuit board for controlling a driver IC mounted on the FPC.

Figure 4B:
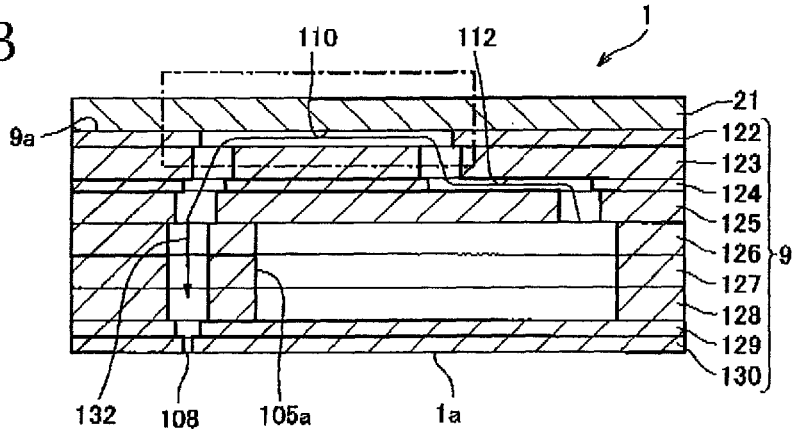
FIG. 4B is a partial cross-sectional view taken along line 1V-1V in FIG. 4A.

As shown in FIG. 4B, the channel unit 9 is a stacked body constituted by nine stainless plates 122-130. In the channel unit 9 are formed ink channels including the pressure chambers 110. The ink channels are constituted by an upstream common ink channel and downstream individual ink channels 132. The common ink channel is constituted by manifold channels 105 and sub-manifold channels 105*a* each branched from a corresponding one of the manifold channels 105. Each of the manifold channels 105 has, at its one end, an ink supply opening 105*b* formed in the upper face 9*a*. Each of the individual ink channels 132 extends from an outlet of a corresponding one of the sub-manifold channels 105*a* to a corresponding one of the ejection openings 108 formed in a lower face of the channel unit 9, i.e., the ejection face 1*a*, via a corresponding ones of the apertures 112 and the pressure chambers 110.

There will be next explained the actuator units 21. As shown in FIG. 2A, each of the eight actuator units 21*a*-21*h* has a trapezoid shape in plan view, and these actuator units 21 are arranged along the main scanning direction so as not to overlap the ink supply openings 105*b*. Also, parallel sides of each of the actuator units 21*a*-21*h* extend in the main scanning direction, and adjacent two oblique lines of the actuator units 21 overlap each other in the sub-scanning direction. It is noted that each of the two actuator units 21*a*, 21*h* arranged on opposite sides in the main scanning direction has one oblique line, and an outer side line of each of the two actuator units 21*a*, 21*h* in the main scanning direction extends in the sub-scanning direction.

Figure 4C:
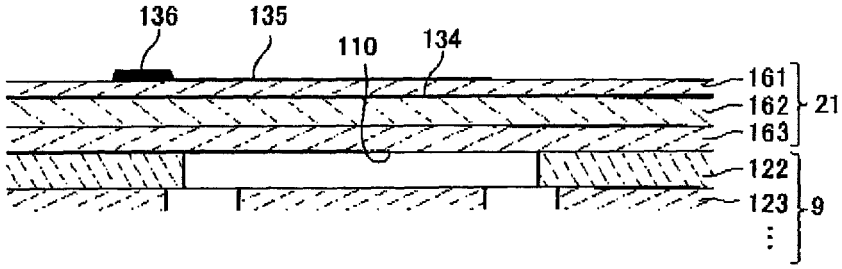
FIG. 4C is an enlarged view illustrating an area enclosed by a one-dot chain line in FIG. 4B.

As shown in FIG. 4C, each of the actuator units 21 is constituted by three piezoelectric layers 161-163 each formed of a ceramic material of lead zirconate titanate (PZT) having ferroelectricity. A plurality of individual electrodes 135 are disposed on an upper face of the uppermost piezoelectric layer 161 that is polarized in its thickness direction. A common electrode 134 is disposed generally entirely on an upper face of the piezoelectric layer 162 and sandwiched between the piezoelectric layer 162 and the piezoelectric layer 161. When an electric field is applied between the electrodes 134, 135 in the polarization direction, the piezoelectric layer 161 as an active portion therebetween is contracted in a planar direction. The piezoelectric layers 162, 163 are not deformed actively, which causes difference in amount of deformation between the piezoelectric layer 161 and the piezoelectric layers 162, 163. As a result, a portion of the piezoelectric layers which is sandwiched between the individual electrode 135 and the pressure chamber 110 projects toward the pressure chamber 110 (noted that this projection is called unimorph deformation). The ink in the pressure chamber 110 is pressurized by this deformation and ejected as an ink droplet.

In this way, the actuator units 21 includes the plurality of actuators respectively for the individual electrodes 135, enabling the ejection energy to be individually applied to the ink. Here, the common electrode 134 is always kept at ground potential. Also, a drive signal is selectively supplied from one of individual lands 136 to a corresponding one of the individual electrodes 135. The individual land 136 is provided on a distal end portion of the individual electrode 135.

The present embodiment adopts what is called a fill-before-fire method for the ink ejection. Each individual electrode 135 is set at a predetermined electric potential in advance, keeping the unimorph deformation of the actuator. When the drive signal is supplied, the electric potential of the individual electrode 135 is temporarily made equal to that of the common electrode 134, and, after a predetermined length of time, returned to the predetermined electric potential. At the timing when the individual electrode 135 is made equal in electric potential to the common electrode 134, the actuator terminates the unimorph deformation, so that the ink is sucked to the pressure chamber 110. Then, at the timing when the electric potential is returned to the predetermined electric potential, the actuator causes the unimorph deformation again, which ejects the ink droplet from the ejection opening 108.

Figure 2B:
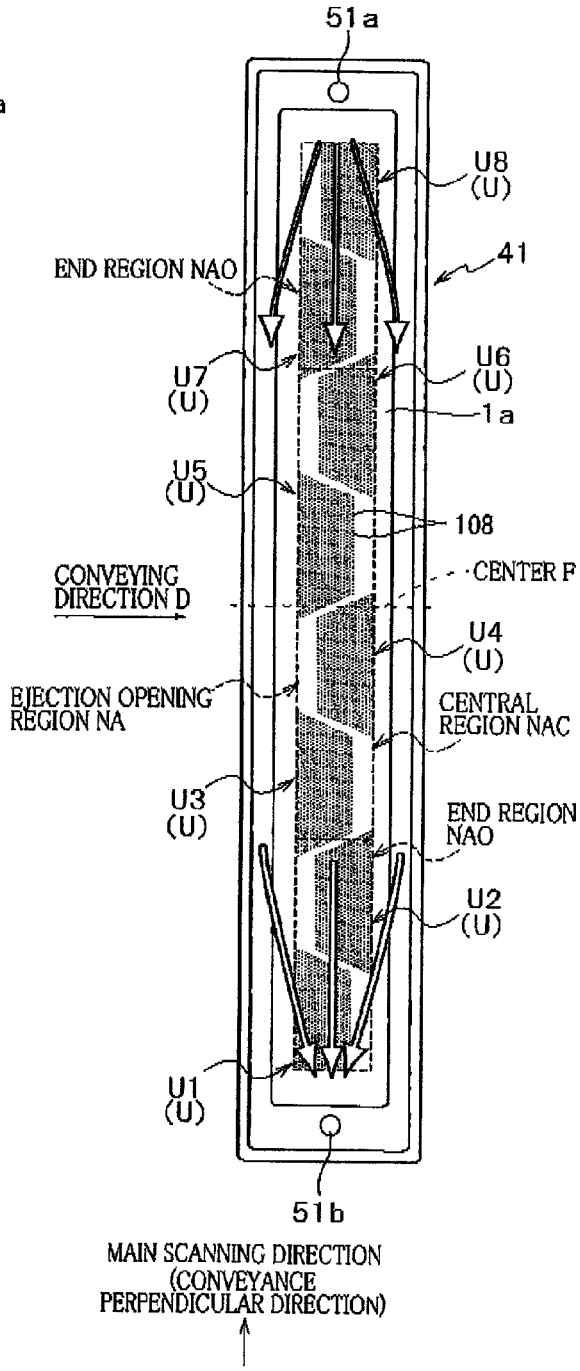
FIG. 2B is a plan view illustrating an ejection face of the ink-jet head.

As shown in FIG. 2B, an ejection opening region NA is formed on the ejection face 1*a*. This ejection opening region NA is a rectangular region elongated in the main scanning direction and including the ejection openings 108 located at opposite ends in the main scanning direction and the sub-scanning direction, in other words, all the ejection openings 108 are formed in the ejection opening region NA. More specifically, the ejection opening region NA is a region defined by (a) two imaginary lines each extending in the sub-scanning direction so as to contact an outside end of a corresponding one of the ejection openings 108 located opposite ends in the main scanning direction and (b) two imaginary lines each extending in the main scanning direction so as to contact an outside end of a corresponding one of the ejection openings 108 located opposite ends in the sub-scanning direction. As shown in FIG. 2B, the ejection opening region NA is divided into three regions along the main scanning direction, namely a central region NAC and two end regions NAO. The central region NAC is interposed between the two end regions NAO. Here, the central region NAC is a region centered about a center F of the ejection opening region NA in the main scanning direction, and the width of this central region NAC in the main scanning direction is equal to half the entire length of the ejection opening region NA. The width (length) of the ejection opening region NA in the main scanning direction is slightly larger than that of a sheet of a maximum size among sheets available in this printer 101 in the main scanning direction. It is noted that the ejection opening region NA may be divided in any manner.

As shown in FIG. 2B, eight ejection-opening groups (ejection areas) U (U1-U8) are formed on the ejection opening region NA so as to be respectively opposed to the actuator units 21. Each of the eight ejection-opening groups U is a trapezoid area in which a plurality of the ejection openings 108 are formed, and these ejection-opening groups U are arranged in a staggered configuration in two rows in the main scanning direction. There are a plurality of non-ejection areas each interposed between adjacent two of the ejection-opening groups U in the main scanning direction. Each of the non-ejection areas is a no-opening-formed area extending along an oblique line of the trapezoid shape and having no ejection openings 108. Also, the eight ejection areas are symmetrical about a point located at generally the center of the ejection opening region NA. The ejection openings 108 constituting the ejection-opening groups U are also symmetrical about the point. It is noted that the plurality of ejection openings 108 are spaced uniformly in the main scanning direction as a whole.

There will be next explained structures of the head holder 13 and the capping mechanism 40 with reference to FIGS. 2A-2B, 6, and 7.

The head holder 13 is a rigid-body frame formed of metal, for example, and supports side faces of the head 1 in its entire perimeter. A pair of joints 51 and the cap member 41 of the capping mechanism 40 are mounted on the head holder 13. Contact portions of the head holder 13 and the head 1 are sealed with a sealant in their entire perimeter. Also, contact portions of the head holder 13 and the cap member 41 are fixed to each other with an adhesive in their entire perimeter.

Figure 7:
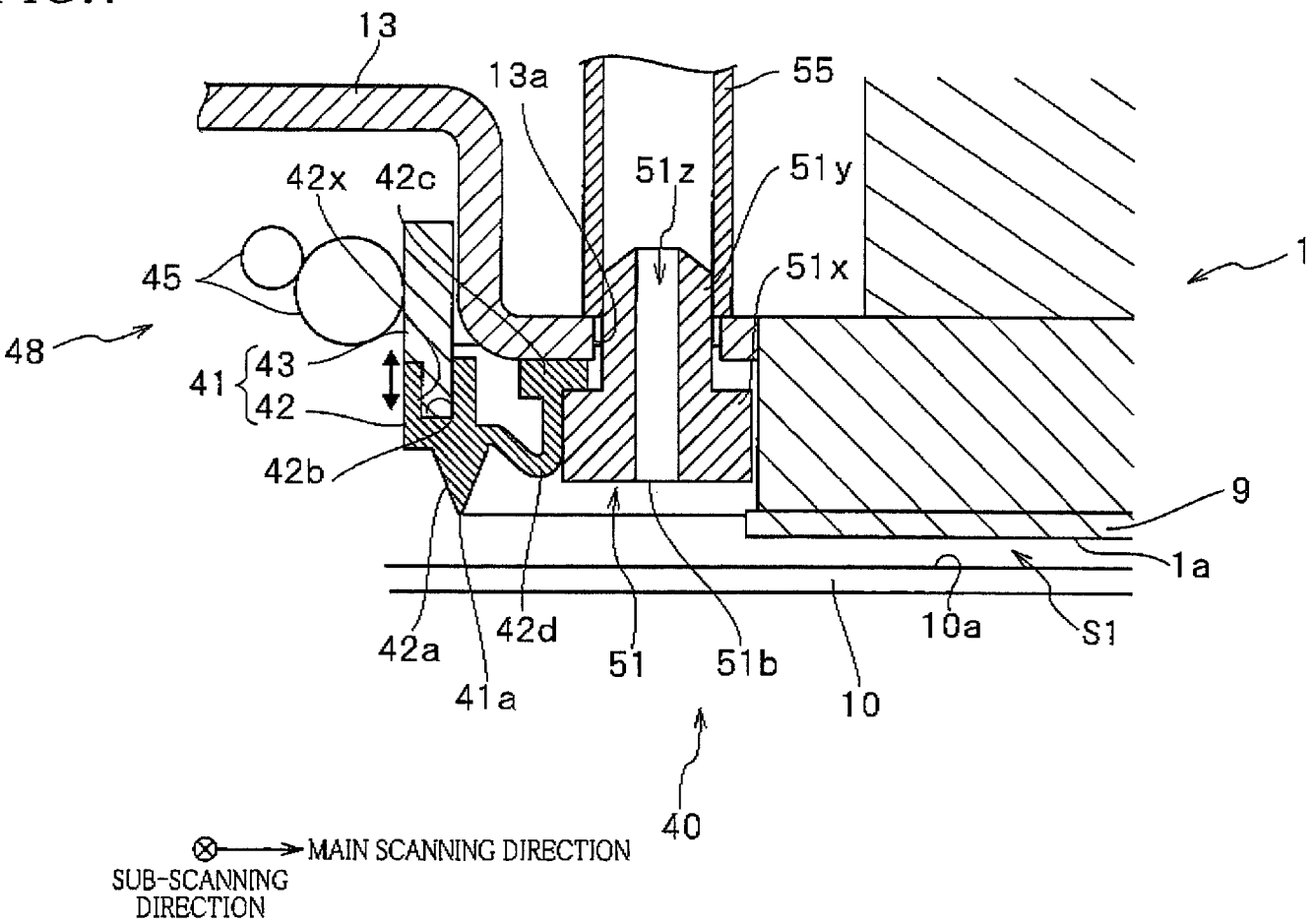
FIG. 7 is a partial cross-sectional view illustrating an area VII enclosed by a one-dot chain line in FIG. 6.

The pair of joints 51 are arranged near the head 1 on opposite sides of the head 1 in the main scanning direction. As shown in FIG. 6, in the humidifying maintenance, the right joint 51 supplies humid air into the ejection space S1. An air supply opening 51*a* is formed in a lower face of the right joint 51. The left joint 51 collects air from the ejection space S1. An air discharge opening 51*b* is formed in a lower face of the left joint 51. As shown in FIG. 7, each of the joints 51 includes a square basal end portion 51*x* and a circular cylindrical portion 51*y*. A hollow space 51*z* is formed through the portions 51*x*, 51*y* in the vertical direction. A distal end portion of the cylindrical portion 51*y* is tapered. The cylindrical portion 51*y* is fitted in a through hole 13*a* of the head holder 13, and a tube 55 is connected on an exposed distal end portion of the cylindrical portion 51*y*. A small clearance is formed between the cylindrical portion 51*y* and the through hole 13*a* but is filled with a sealing material, for example.

It is noted that as shown in FIG. 2B each of the air supply opening 51*a* and the air discharge opening 51*b* is a round opening that is smaller than the ejection opening region NA in the sub-scanning direction. In the present embodiment, a midpoint between the air supply opening 51*a* and the air discharge opening 51*b* in the main scanning direction, i.e., the conveyance perpendicular direction coincides with the center F of the ejection opening region NA. This design enables effective supply of the humid air to the ejection openings 108.

The capping mechanism 40 includes: the cap member 41; a cap elevating and lowering mechanism 48 for elevating and lowering the cap member 41; the facing member 10; and a facing-member elevating and lowering mechanism 49 (see FIG. 9) for elevating and lowering the facing member 10. The cap member 41 can enclose the ejection space S1 with the head 1 and is elongated in the main scanning direction. As shown in FIG. 7, the cap member 41 includes: an elastic member 42 supported by the head holder 13; and a movable member 43 movable upward and downward.

The elastic member 42 is formed of an elastic material such as rubber and encloses the head 1 in plan view. As shown in FIG. 7, the elastic member 42 includes: a base portion 42*x*; a projecting portion 42*a* projecting downward from the base portion 42*x*; a fixed portion 42*c* fixed to the head holder 13; and a connecting portion 42*d* connecting between the base portion 42*x* and the fixed portion 42*c*. The projecting portion 42*a* projects from a lower face of the base portion 42*x* and has a triangle shape in its cross section. The fixed portion 42*c* has a T-shape in its cross section. An upper end portion of the fixed portion 42*c* is fixed to the head holder 13 with an adhesive or any other suitable material. Near the through hole 13*a*, the fixed portion 42*c* is supported by and between the head holder 13 and the joint 51, specifically, the basal end portion 51*x*. The connecting portion 42*d* curves and connects between a lower end of the fixed portion 42*c* which is located inside the connecting portion 42*d* and a lower end of the base portion 42*x* which is located outside the connecting portion 42*d*. The curve of the connecting portion 42*d* allows the base portion 42*x* to be moved upward and downward by the movable member 43. An upper face of the base portion 42*x* has a recessed portion 42*b* that is fitted on a lower end of the movable member 43.

The movable member 43 is formed of a rigid material such as stainless steel and encloses the outer circumferential face of the head 1 in plan view. The movable member 43 is supported by the head holder 13 via the elastic member 42 and movable in the vertical direction relative to the head holder 13.

The cap elevating and lowering mechanism 48 includes gears 45 and an up/down motor, not shown. The gears 45 are engaged with the movable member 43. When the up/down motor is driven by the control device 100, the gears 45 are rotated to move the movable member 43 upward or downward. The base portion 42*x* is also moved upward or downward with the movable member 43. As a result, a position of a distal end 41*a* of the projecting portion 42*a* relative to the ejection face 1*a* is changed in the vertical direction.

With the upward or downward movement of the movable member 43, the projecting portion 42*a* is selectively positioned at one of a contact position (see FIG. 6) at which the distal end 41*a* is located below the ejection face 1*a* (in other words, the distal end 41*a* is located in front of the ejection face 1*a* in an ink ejecting direction); and a distant position (see FIG. 7) at which the distal end 41*a* is located above the ejection face 1*a* (in other words, the distal end 41*a* is located at a rear of the ejection face 1*a* in the ink ejecting direction). At the contact position, the distal end 41*a* of the projecting portion 42*a* is held in contact with the face 10*a* of the facing member 10 located at a first position which will be described below, so that the ejection space S1 is isolated from the outside space S2, that is, the ejection space S1 is changed to the sealing state. At the distant position, on the other hand, the distal end 41*a* of the projecting portion 42*a* is spaced apart from the face 10*a* of the facing member 10, so that the ejection space S1 is open to the outside space S2, that is, the ejection space S1 is changed to an open state (or a non-sealed state).

The facing member 10 is a glass plate having a rectangular planar shape which is one size larger than the cap member 41 in plan view.

The facing-member elevating and lowering mechanism 49 is configured to elevate and lower the facing member 10 between the first-fourth positions. At the first position as shown in FIG. 3A, the facing member 10 is the nearest to the ejection face 1*a* among the first-fourth positions, and a distance between the face 10*a* and the ejection face 1*a* is equal to a distance between the support face of the support portion 6 and the ejection face 1*a*. The before-use flushing is performed when the facing member 10 is located at this first position.

Figure 3B:
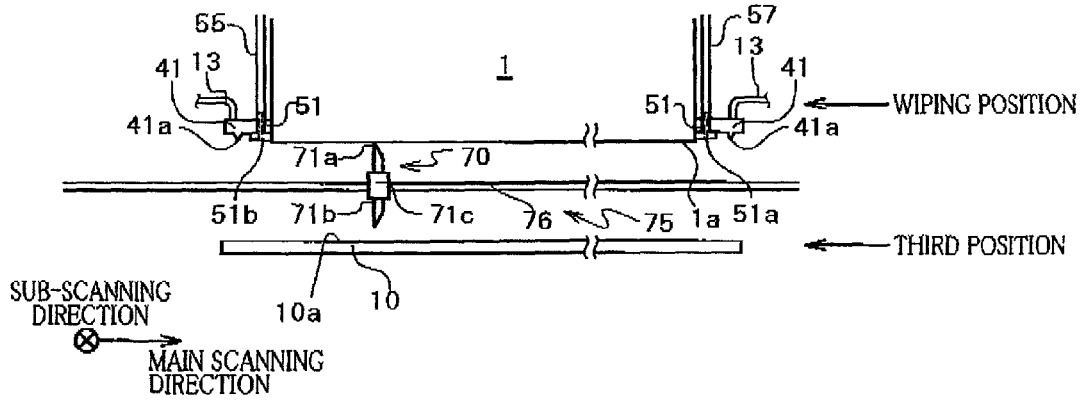
Figure 3C:
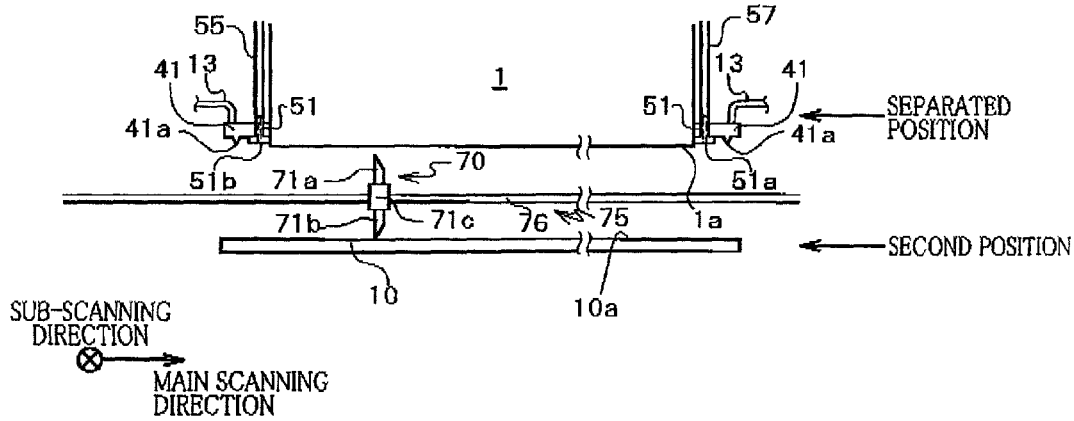

At the second position as shown in FIG. 3C, the distance between the face 10*a* and the ejection face 1*a* is larger than that at the first position. The second wiping is performed when the facing member 10 is located at this second position.

At the third position as shown in FIG. 3B, the distance between the face 10*a* and the ejection face 1*a* is larger than that at the second position. The purging and the first wiping are performed when the facing member 10 is located at this third position. At the fourth position as shown in FIG. 1, the distance between the face 10*a* and the ejection face 1*a* is the largest among those at the first-fourth positions.

There will be next explained the structure of the humidifying mechanism 50 with reference to FIG. 6.

As shown in FIG. 6, the humidifying mechanism 50 as one example of a humidification unit includes: the pair of joints 51; the tube 55 and a tube 57; a humidification pump 56; and a tank 54. The tube 55 is fitted at one end thereof on the left joint 51 and connected at the other end thereof to the tank 54. The tube 57 is fitted at one end thereof on the right joint 51 and connected at the other end thereof to the tank 54. The tubes 55, 57 thus establish communication between the ejection space S1 and the tank 54.

As shown in FIG. 6, the humidification pump 56 is provided on the tube 55. When driven, the humidification pump 56 always delivers or transfers air in one direction. This one direction is a direction directed from the humidification pump 56 toward the tank 54.

The tank 54 as one example of a liquid storage stores water (as humidification liquid) in its lower space and stores in its upper space humid air that is humidified by the water in the lower space. An upper wall of the tank 54 has an air communicating hole, not shown, for communication between the inside of the tank 54 and ambient air. The tube 55 is in communication with the lower space of the tank 54 (beneath a water surface) while the tube 57 is in communication with the upper space of the tank 54. It is noted that a check valve, not shown, is attached to the tube 55 for preventing the water in the tank 54 from flowing to the air discharge opening 51*b*, so that air flows only in a direction indicated by white arrows in FIG. 6. Also, when an amount of the water in the tank 54 becomes small, the tank 54 is replenished with water from a water replenish tank, not shown.

When the humidifying maintenance is performed with the ejection space S1 being in the sealing state, the control device 100 controls the humidification pump 56 to, as shown in FIG. 6, circulate the air in the tank 54 in the direction indicated by the white arrows. The humid air in the upper space is supplied from the air supply opening 51*a* into the ejection space S1. The air in the ejection space S1 flows toward the air discharge opening 51*b* while being replaced with the humid air. Since the tube 55 communicates with the tank 54 underwater, the air in the ejection space S1 is humidified in the tank 54. The produced humid air is supplied from the upper space to the ejection space S1 during the driving of the humidification pump 56. In this operation, the humid air is efficiently supplied to the ejection openings 108 within the ejection opening region NA.

It is noted that, during a period in which the humidifying maintenance is performed in the sealing state of the ejection space S1, i.e., in the capping (noted that this period may be hereinafter referred to as "humidifying period" in which the humidification pump 56 is driven), the humid air is supplied into the ejection space S1 as described above, but amounts of water replenished or supplied to the ink in the ejection openings 108 have nonuniform distribution. Also, the humidifying maintenance is performed only for a set specific period in the capping. Thus, during a period in which the humidifying maintenance is not performed in the capping (noted that this period may be hereinafter referred to as "non-humidifying period" in which the humidification pump 56 is not driven), the viscosity of the ink increases. A degree of the increase in the viscosity of the ink varies with not only a length of the non-humidifying period but also operations for the ejection openings 108 just before the capping. In order to discharge the thickened ink from the ejection openings 108 in the present embodiment, the before-use flushing is performed before a start of use of the head 1 (i.e., before the image recording). It is noted that the non-humidifying period is shorter than the humidifying period in the present embodiment.

Here, FIG. 8A generally represents distribution of humidity near the ejection face 1*a* in the main scanning direction within the ejection space S1 during the capping. The horizontal axis indicates a position in the main scanning direction, and the vertical axis indicates an average value of the humidity in the sub-scanning direction at each position in the main scanning direction. In the humidifying period, the humidity is high on a side near the air supply opening 51*a*, and the humidity distribution indicates slight decline toward the air discharge opening 51*b*. At the opposite end portions of the ejection space S1, the humidity distribution indicates greater decline than at the central portion. When the humid air is delivered from the air supply opening 51*a* toward the air discharge opening 51*b*, water or moisture of the humid air is absorbed by surrounding wall faces including the ejection openings 108, resulting in inclination of the distribution. As shown in FIG. 2B, the humid air flows toward the air discharge opening 51*b*. The air near the air supply opening 51*a* spreads out or diverges in the sub-scanning direction while flowing toward the air discharge opening 51*b*. The air near the air discharge opening 51*b* converges toward the opening 51*b*. Therefore, at the opposite end portions of the ejection space S1 (specifically, near and outside the air supply opening 51*a* and the air discharge opening 51*b*), the absorption of the moisture by wall faces on three sides and the distribution of the air flow cause insufficiency of the supply of the humid air or water vapor, thereby lowering the humidity when compared with a central portion of the ejection space S1.

In the non-humidifying period, the humidity distribution in the ejection space S1 is pronounced, that is, the humidity is considerably low in space areas near the air supply opening 51*a* and the air discharge opening 51*b* when compared to the humidity in the other space areas. This is mainly due to residual ink remaining on or adhering to the facing member 10 and the cap member 41 of the capping mechanism 40. The following is a specific explanation focusing on the residual ink remaining on the cap member 41.

To an inner face of the cap member 41 which defines the ejection space S1, an ink mist may be attached in the image recording, and part of the ink may be attached in the first wiping. After drying, such residual ink acts as a drying agent. Here, in a space area of the ejection space S1 which is opposed to the central region NAC, the humidity lowers mainly due to residual ink remaining on two side faces of the cap member 41 which extend in the main scanning direction. In space areas of the ejection space S1 which are respectively opposed to the end regions NAO, the humidity lowers mainly due to not only residual ink remaining on the two side faces of the cap member 41 which extend in the main scanning direction but also residual ink remaining on one side face of the cap member 41 which extends in the sub-scanning direction. Also, less humid air is supplied to the space areas outside the air supply opening 51*a* and the air discharge opening 51*b* in the main summing direction than to the space area interposed between the air supply opening 51*a* and the air discharge opening 51*b*. Thus, the humidity is low in these space areas in the humidifying period. This results in great increase in viscosity of the residual ink contacting the outside space areas in the main scanning direction. Also, in the first wiping, more residual ink remains on opposite end areas of the cap member 41 in the main scanning direction than on a central area on the cap member 41 in the main scanning direction. Therefore, assuming that the viscosities of the ink in the ejection openings 108 are the same as one another before the non-humidifying period, a degree of the drying (i.e., a drying degree) of the ink per unit time in the non-humidifying period is greater in each ejection opening 108 within the end regions NAO than in each ejection opening 108 within the central region NAC.

Also, since the humid air flows from the air supply opening 51*a* toward the air discharge opening 51*b* in the humidifying period, more residual ink accumulates on a side nearer to the air discharge opening 51*b* on the cap member 41. Thus, the humidity lowers more in the space area near the air discharge opening 51*b* in the ejection space S1. As a result, assuming that the viscosities of the ink in the ejection openings 108 are the same as one another before the non-humidifying period, the drying degree per unit time is greater in the ejection openings 108 within the end region NAO near the air discharge opening 51*b* among the two end regions NAO.

In the capping, as described above, the ink in the ejection openings 108 is replenished with water by the humidifying maintenance, and then water of the ink is lost or deprived. In the humidifying maintenance (in the humidifying period), the amounts of water supplied to the ink in the ejection openings 108 have nonuniform distribution because of the effects such as the flow path of the humid air, the positions of the air supply opening 51*a* and the air discharge opening 51*b* in the ejection space S1, and the absorption of the moisture by the inner wall faces defining the ejection space S1. Amounts of the water lost from the ink after the humidifying maintenance (in the non-humidifying period) also have distribution because of effects such as the inner wall face defining the ejection space S1 and the accumulation of the residual ink. Due to these effects, the drying degree per unit time is greater in the end regions NAO than in the central region NAC and greater in the end region NAO near the air discharge opening 51*b* than in the end region NAO near the air supply opening 51*a*. Thus, in a case where the same amount of ink is discharged from each of all the ejection openings 108 in the before-use flushing without variations among the ejection-opening groups U, the amount of the ink is determined so as to meet the condition of the area near the air discharge opening 51*b*, resulting in increase in the flushing amount. In the present embodiment, amounts of the ink discharged from all the ejection openings 108 in the flushing (hereinafter referred to as "flushing amount(s)") are not made uniform, and the amounts of the ink discharged from the respective ejection openings 108 are determined for each of the ejection-opening groups U. That is, for each of the ejection-opening groups U, the same amount of the ink is discharged from each of a plurality of the ejection openings 108. Also, since the ejection-opening groups U respectively correspond to the actuator units 21, the ejection of the ink in the same flushing amount within each ejection-opening group U facilitates the control for the before-use flushing. It is noted that the flushing amount is one example of a liquid-discharge-amount, and in the following explanation, the term "flushing amount" may be used as the amount of the ink ejected from all or a part of the ejection openings 108.

Figure 5:
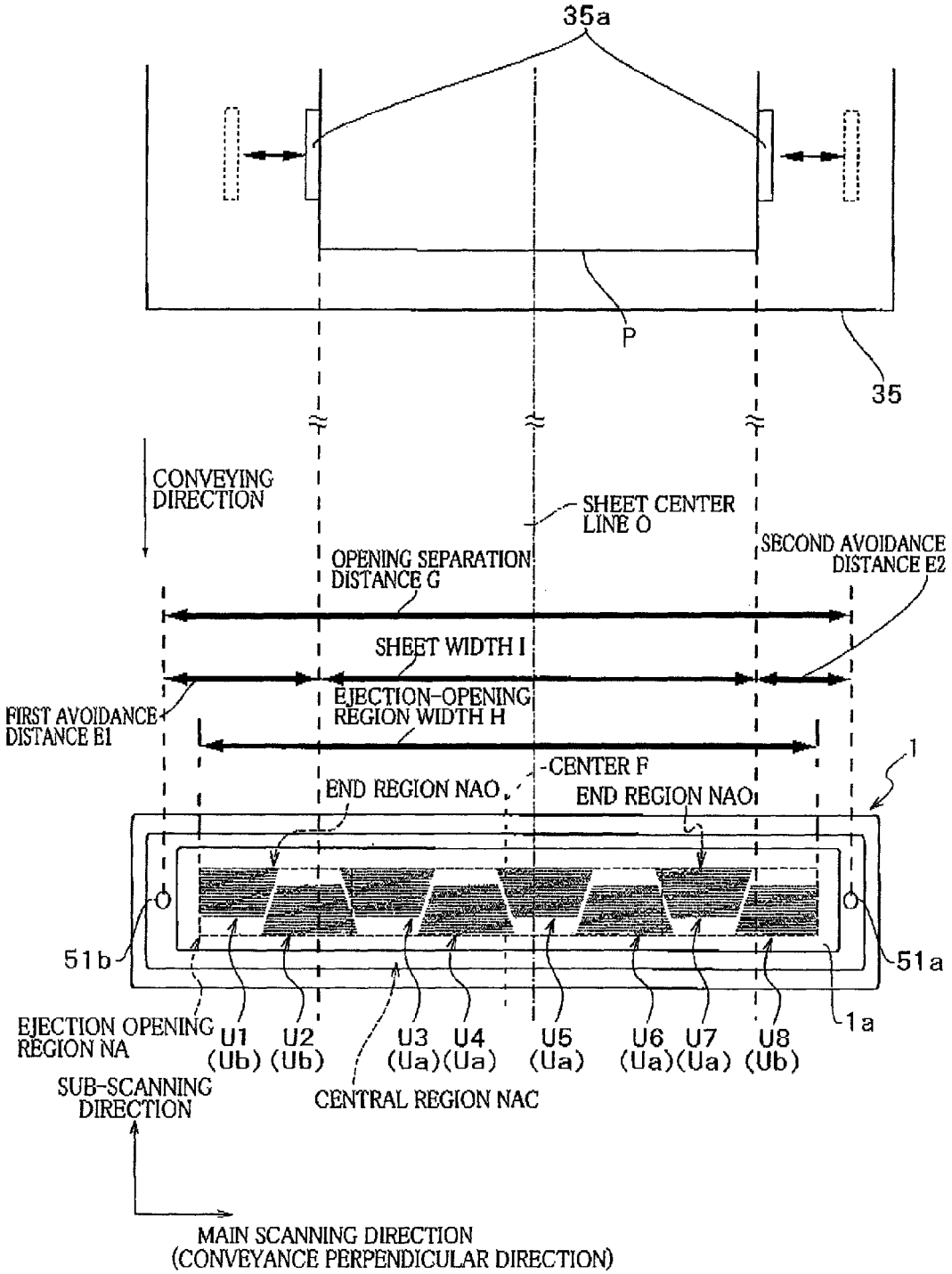
FIG. 5 is a schematic view illustrating a positional relationship between a position of a sheet accommodated in a sheet-supply unit and the ejection face of the ink-jet head in the printer in FIG. 1.

There will be next explained the sheet positioning walls 35*a* with reference to FIG. 5.

As shown in FIG. 5, the pair of sheet positioning walls 35*a* are designed such that when one of them is moved in the main scanning direction, the other of them automatically moves in the opposite direction by the same distance. That is, a center between the pair of sheet positioning walls 35*a* in the main scanning direction is located at the same position regardless of the position of these sheet positioning walls 35*a*. In other words, the center of the sheet P in the main scanning direction is located at the same position on the sheet-supply tray 35 regardless of the size of the sheet P.

Here, as indicated by the humidity distribution in the humidifying period (see FIG. 8A), the amount of water replenished to the ink changes greatly in the ejection openings 108 near the air supply opening 51*a* and the air discharge opening 51*b* as described above, which may lead to a shortage of the water supplied to the ink when compared to other areas. The shortage of the water supplied is partly caused by a difference in size between the ejection opening region NA and each of the air supply opening 51*a* and the air discharge opening 51*b*. The ejection opening region NA is greater in length than each of the air supply opening 51*a* and the air discharge opening 51*b* in the sub-scanning direction. Thus, as shown in FIG. 2B, the flow path of the humid air is not uniform. The flow path is narrow at the areas near the air supply opening 51*a* and the air discharge opening 51*b*, so that the degree of the water replenishment in the sub-scanning direction has distribution at the areas near the air supply opening 51*a* and the air discharge opening 51*b*. That is, each of the areas near the air supply opening 51*a* and the air discharge opening 51*b* includes an area in which the length (flow width) of the flow of the humid air in the sub-scanning direction is less in length than that in areas other than the areas near the air supply opening 51*a* and the air discharge opening 51*b*, and art this area there are differences in the degree of the water replenishment in the sub-scanning direction. Incidentally, residual ink adhering to the cap member 41 affects the drying degree of each ejection opening 108. This effect depends on the amount of the residual ink and its distribution, which vary with elapse of time. Nevertheless, the effect on the ejection opening 108 by the residual ink increases with decrease in distance from the air supply opening 51*a* and the air discharge opening 51*b* as described above. This is due to, for example, a direction and an area of the wiping of the wipers 71*a*, 71*b*, the direction of the flow of the humid air, and a design of the inner wall faces defining the ejection space S1. At least, in the ejection-opening groups U1, U8 located at the opposite ends in the main scanning direction include the ejection openings 108 in which the increase in viscosity of the ink is greater than that in the other groups.

When the image recording is performed from these ejection openings 108, inconsistency may occur in the image recorded on the sheet P. To prevent such inconsistency, the present embodiment adopts conveyance using what is called center registration. In this center registration, a central position between the pair of sheet positioning walls 35*a* in the main scanning direction is determined such that the sheet P is conveyed in the image recording so as to avoid an area within a first avoidance distance E1 from the air discharge opening 51*b* and an area within a second avoidance distance E2 from the air supply opening 51*a* in the main scanning direction. In other words, the central position between the pair of sheet positioning walls 35*a* in the main scanning direction is determined such that the sheet P is conveyed in the image recording so as not to overlap the area within the first avoidance distance E1 from the air discharge opening 51*b* and the area within the second avoidance distance E2 from the air supply opening 51*a* in the main scanning direction when seen in a direction perpendicular to the ejection face 1*a*.

Here, the first avoidance distance E1 is a distance from the air discharge opening 51*b* to an area in which a difference in the drying degree in the capping per unit time between adjacent two of the ejection openings 108 in the main scanning direction becomes equal to or less than a set specific amount value. Likewise, the second avoidance distance E2 is a distance from the air supply opening 51*a* to an area in which a difference in the drying degree in the capping per unit time between adjacent two of the ejection openings 108 in the main scanning direction becomes equal to or less than the set specific amount value. A sum (i.e., a total value) of the first avoidance distance E1 and the second avoidance distance E2 is greater than a value obtained by subtracting the width H of the ejection opening region NA in the conveyance perpendicular direction from an opening separation distance G between the air supply opening 51*a* and the air discharge opening 51*b* in the conveyance perpendicular direction and equal to or less than a value obtained by subtracting a sheet width I of the sheet P in the conveyance perpendicular direction from the opening separation distance G (in the present embodiment, the sum (the total value) is equal to the value obtained by subtracting the sheet width I from the opening separation distance G). Thus, the image recording can be performed using the ejection openings 108 located near the air supply opening 51*a* and the air discharge opening 51*b* as less as possible, making it possible to suppress occurrence of the inconsistency in the image on the sheet P in the image recording.

As described above, more residual ink exists near the air discharge opening 51*b* than near the air supply opening 51*a* in the cap member 41. Thus, in the present embodiment, a sheet center line O extending along the sheet conveyance path from the central position located between the pair of sheet positioning walls 35*a* in the main scanning direction is located within the central region NAC and extends through a position located nearer to the air supply opening 51*a* than the center F (i.e., a position offset from the center F toward the air supply opening 51*a*) when seen in the direction perpendicular to the ejection face 1*a*. That is, in the image recording, the center of the sheet P in the main scanning direction is located within the central region NAC of the ejection opening region NA and opposed to the position located nearer to the air supply opening 51*a* than the center F when seen in the direction perpendicular to the ejection face 1*a*. Also, the first avoidance distance E1 is longer than the second avoidance distance E2. As a result, it is possible to further suppress the occurrence of the inconsistency in the image in the image recording.

As a modification, the central position between the pair of sheet positioning walls 35*a* in the main scanning direction may be determined such that the sheet P is not opposed in the image recording to one of the ejection openings 108 nearest to the air discharge opening 51*b* in the main scanning direction and one of the ejection openings 108 nearest to the air supply opening 51*a* in the main scanning direction when seen in the direction perpendicular to the ejection face 1*a*. In this configuration, the image recording is performed on the recording medium without using the ejection openings 108 in which the drying degree of the ink greatly differs from that in the other ejection openings 108, making it possible to further suppress the occurrence of the inconsistency in the image.

Figure 9:
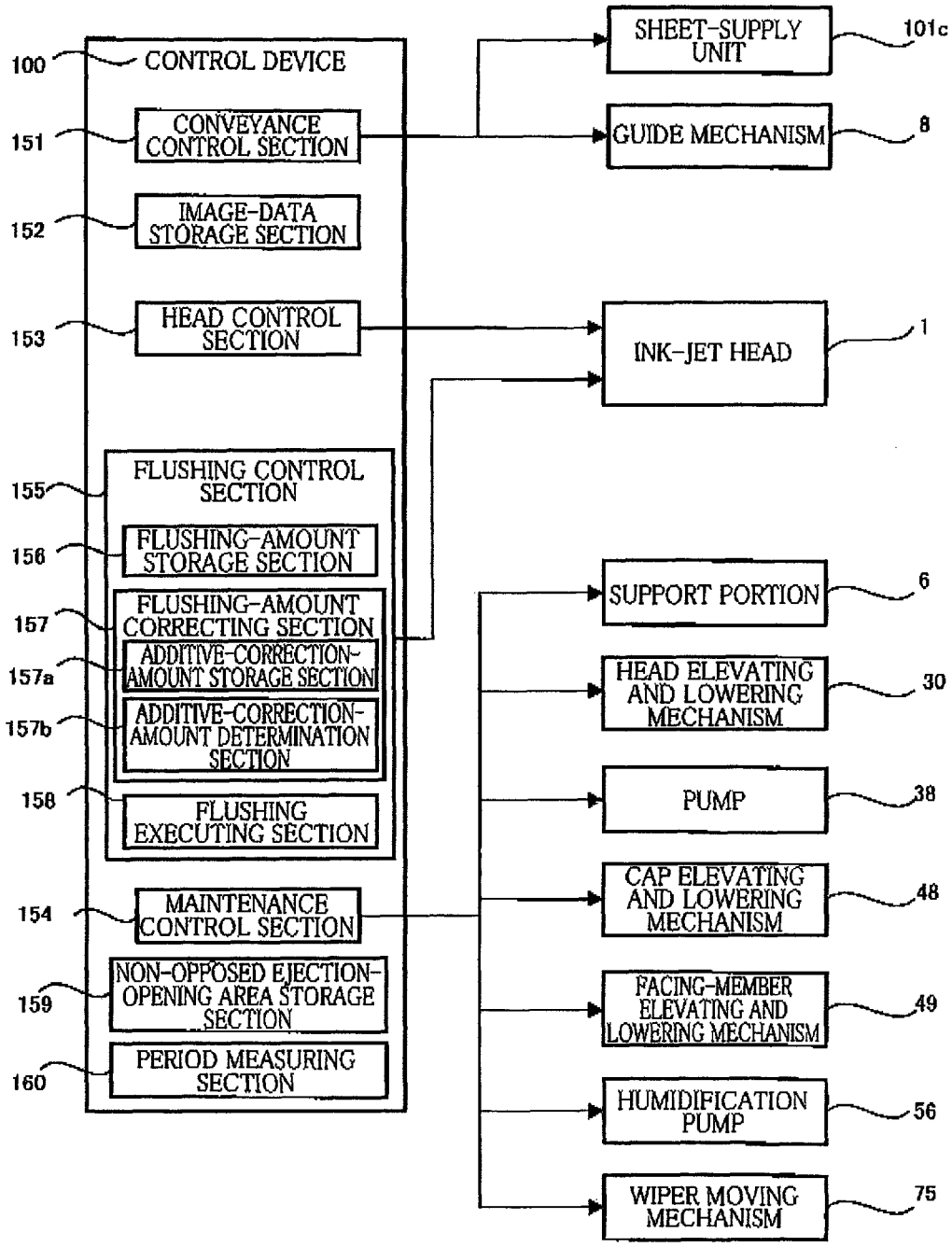
FIG. 9 is a block diagram of a general structure of a control device in FIG. 1.

There will be next explained the control device 100 with reference to FIG. 9. The control device 100 includes: a central processing unit (CPU); a read only memory (ROM) rewritably storing programs to be executed by the CPU and data used for these programs; and a random access memory (RAM) for temporarily storing the data in the execution of the programs. The control device 100 includes various functional sections which are constituted by cooperation of these hardware and software in the ROM with each other. As shown in FIG. 9, the control device 100 includes a conveyance control section 151, an image-data storage section 152, a head control section 153 as one example of a recording control unit, a maintenance control section 154, a flushing control section (unit) 155, a non-opposed ejection-opening area storage section 159, and a period measuring section 160.

The conveyance control section 151 is configured, based on the recording command transmitted from the external device, to control the sheet-supply unit 101*c* and the guide mechanism 8 to convey the sheet P at a predetermined speed in the conveying direction. The image-data storage section 152 is configured to store the image data (i.e., ink ejection data) contained in the recording command transmitted from the external device.

The head control section 153 is configured to control the head 1 based on the image data stored in the image-data storage section 152 to eject the ink onto the sheet P in the image recording. The control for the head 1 is executed in synchronization with the conveyance of the sheet P on the basis of the sense signal supplied upon the sense of the leading edge of the sheet P. The control based on the image data is started in a predetermined length of time after the sense of the leading edge of the sheet P. At this timing, a leading edge of a print area of the sheet P reaches a position just under the most upstream ones of the ejection openings 108.

The maintenance control section 154 controls the support portion 6, the head elevating and lowering mechanism 30, the pump 38, the cap elevating and lowering mechanism 48, the facing-member elevating and lowering mechanism 49, the humidification pump 56, and the wiper moving mechanism 75 in the purging, the first wiping, the second wiping, the capping, and the humidifying maintenance.

The flushing control section 155 controls the head 1 in the recording flushing and the before-use flushing. The recording flushing is an operation for maintaining the ejection characteristics in the image recording. In the recording flushing, the flushing control section 155 controls the head 1 to discharge the ink from some or all of the ejection openings 108 opposed to the sheet P based on the flushing data to form flushing dots on the sheet P. In the before-use flushing, the flushing control section 155 controls the head 1 to discharge the ink from a plurality of the ejection openings 108 based on flushing amounts stored in a flushing-amount storage section 156 which will be described below. The before-use flushing is performed just before the print job, e.g., just after the printer 101 is turned on and during waiting between print jobs. It is noted that, to change the flushing amount of the ink discharged from the ejection opening 108, the number of ejections in flushing, i.e., the number of successive ejections may be changed, or alternatively, an amount of one liquid droplet in ejection in the flushing may be changed. In the present embodiment, the flushing amount is changed by changing the number of ejections in flushing.

The non-opposed ejection-opening area storage section 159 is configured to store an area of the ejection opening region NA which is not opposed to the sheet P and from which no ink is ejected in image recording that is performed within a period from later one of the previous (i.e., preceding) before-use flushing and the previous (i.e., preceding) purging to the current before-use flushing (i.e., the humidifying maintenance). The non-opposed ejection-opening area storage section 159 is configured to initialize the stored area of the ejection opening region NA when the before-use flushing or the purging is performed.

The period measuring section 160 is configured to measure the humidifying period and the non-humidifying period within a capping period in which the capping is performed.

There will be next explained the flushing control section 155 in detail. The flushing control section 155 includes the flushing-amount storage section 156 as one example of a liquid-discharge-amount storage device, a flushing-amount correcting section 157 as one example of a liquid-discharge-amount correcting unit, and a flushing executing section (unit) 158.

The flushing-amount storage section 156 is configured to store, for each of the ejection openings 108, the flushing amount of the ink discharged from the ejection opening 108 (i.e., the number of ejections in flushing) in the before-use flushing. As described above, for each ejection-opening group U, the flushing amounts for the ejection openings 108 are equal to one another in the before-use flushing. Thus, for each ejection-opening group U, the number of ejections in flushing is the same among the ejection openings 108. The flushing-amount storage section 156 stores in advance a reference ejection number (1000 in the present embodiment) that is used as a reference for the number of ejections in flushing in the before-use flushing. This reference ejection number is the minimum number of ejections from each of the ejection openings 108 in the before-use flushing within the capping period, regardless of the humidifying period or the non-humidifying period. When the purging or the before-use flushing is to be started, the flushing-amount storage section 156 initializes the number of ejections in flushing to the reference ejection number.

The flushing-amount correcting section 157 is configured to correct the flushing amount (i.e., the number of ejections in flushing) stored in the flushing-amount storage section 156 by adding a set specific value to the reference ejection number, and this correction may be hereinafter referred to as "additive correction". The flushing executing section 158 is configured to control the head 1 to discharge the ink from a plurality of the ejection openings 108 based on the flushing amounts stored in the flushing-amount storage section 156.

There will be next explained the flushing-amount correcting section 157 in detail. As shown in FIG. 9, the flushing-amount correcting section 157 includes an additive-correction-amount storage section 157*a* and an additive-correction-amount determination section 157*b*.

As shown in FIGS. 8B, 8C, the additive-correction-amount storage section 157*a* is configured to store additive correction amounts (i.e., the additive correction numbers) with respect to the reference ejection number stored in the flushing-amount storage section 156. Each of the additive correction amounts is an amount of correction per hour for each of the humidifying period and the non-humidifying period. The additive correction amounts are tabulated for each of the ejection-opening groups U.

The additive correction numbers based on the humidifying period correspond to the humidity distribution in the ejection space S1 in the humidification. As a whole, the additive correction number decreases with increase in distance from the air discharge opening 51*b* toward the air supply opening 51*a*. Also, as described above, where the width of each of the air supply opening 51*a* and the air discharge opening 51*b* in the sub-scanning direction is less than the width of the ejection opening region NA, the ejection-opening group U1 and the ejection-opening group U8 located on the opposite sides include ejection openings 108 in which the ink is not sufficiently replenished with water due to its insufficient contact with humid air. To solve this problem, the additive-correction-amount determination section 157*b* takes the effect of the flow path of the humid air into consideration for the ejection-opening group or groups U located within a first flow distance from the air supply opening 51*a*, i.e., the ejection-opening group U8 in the present embodiment, and the ejection-opening group or groups U located within a second flow distance from the air discharge opening 51*b*, i.e., the ejection-opening group U1 in the present embodiment. That is, each of the correction numbers for the respective ejection-opening groups U1, U8 is greater than that for the ejection-opening groups U2, U7 adjacent thereto. Here, the first flow distance is a distance from the air supply opening 51*a* to a position at which the distance of the flow of the humid air in the sub-scanning direction becomes greater than the width of the ejection opening region NA in the sub-scanning direction. Likewise, the second flow distance is a distance from the air discharge opening 51*b* to a position at which the distance of the flow of the humid air in the sub-scanning direction becomes greater than the width of the ejection opening region NA in the sub-scanning direction. It is noted that assuming that a small amount of the ink dries in the humidifying period, the correction number is regarded as a positive value in the present embodiment, but the correction number may be regarded as a negative value assuming that the water replenishment outpaces the drying of the ink. In any case, the correction number is adjusted for each of the ejection-opening groups U, thereby reducing or suppressing the flushing amount to be consumed.

The additive correction numbers based on the non-humidifying period are determined based on the humidity distribution in the ejection space S1 in the non-humidifying period. Each of the additive correction numbers for discharge-side ejection-opening groups including ejection openings 108 located within a first distance from the air discharge opening 51*b*, i.e., the ejection-opening groups U1, U2 in the present embodiment and for supply-side ejection-opening groups including ejection openings 108 located within a second distance from the air supply opening 51*a*, i.e., the ejection-opening groups U7, U8 in the present embodiment is set to be larger than each of the additive correction numbers for the other ejection-opening groups (as one example of third additive correction amounts). Also, each of the additive correction amounts respectively for the discharge-side ejection-opening groups U1, U2 is set to be larger than each of the additive correction amounts respectively for the supply-side ejection-opening groups U7, U8. As a result, a difference between the flushing amount of the ink discharged from each of the supply-side ejection-opening groups U7, U8 and the discharge-side ejection-opening groups U1, U2 and the flushing amount of the ink discharged from each of the other ejection-opening groups U3-U6 increases with increase in the non-humidifying period. As a result, the ejection characteristics of the ejection openings 108 can be recovered according to the drying degree in the ejection openings 108 in the non-humidifying period, making it possible to reduce the flushing amount in the before-use flushing.

Also, the additive correction amount (a second additive correction amount) increases with decrease in distance from the air discharge opening 51*b* for the discharge-side ejection-opening groups, and the additive correction amount (a first additive correction amount) increases with decrease in distance from the air supply opening 51*a* for the supply-side ejection-opening groups. As a result, the ejection characteristics of the ejection openings 108 can be recovered according to the humidity distribution in the non-humidifying period, making it possible to reduce the flushing amount in the before-use flushing.

Here, the first distance is a distance in the main scanning direction from the air discharge opening 51*b* to an area in which a difference between humidity at the area and the highest humidity in the ejection space S1 (i.e., the highest humidity in the space area opposed to the central region NAC) is equal to a predetermined value in the ejection space S1 in the non-humidifying period, and the second distance is a distance in the main scanning direction from the air supply opening 51*a* to an area in which a difference between humidity at the area and the highest humidity in the ejection space S1 becomes equal to the predetermined value in the ejection space S1 in the non-humidifying period. It is noted that a sum of the first distance and the second distance is shorter than the opening separation distance G. Also, the first distance is longer than the second distance. Furthermore, the first distance and the second distance are determined such that there is at least one ejection-opening group U that does not contain the ejection openings 108 formed in the area within the first distance and the area within the second distance. It is noted that the first distance and the second distance are not limited to those described above. The first distance and the first avoidance distance E1 may or may not be equal to each other, and likewise, the second distance and the second avoidance distance E2 may or may not be equal to each other.

As shown in FIG. 8A, the humidity distribution in the non-humidifying period inclines more than that in the humidifying period. Thus, differences in the increase in viscosity of the ink in the ejection openings 108 among the ejection-opening groups U are greater in the non-humidifying period than in the humidifying period. Accordingly, differences of the additive correction amounts among the ejection-opening groups U are greater in the non-humidifying period than in the humidifying period. That is, distribution of the additive correction amounts for the ejection-opening groups U in the non-humidifying period is greater than that in the humidifying period.

The additive-correction-amount determination section 157*b* is configured to determine the additive correction numbers that are added in the additive correction to the reference ejection number stored in the flushing-amount storage section 156. The following is a detailed explanation thereof. The additive-correction-amount determination section 157*b* initially refers to the additive-correction-amount storage section 157*a* to determine additive ejection numbers in flushing (hereinafter may be referred to as "period additive ejection numbers") based on the humidifying period and the non-humidifying period measured by the period measuring section 160. It is noted that the additive correction numbers corresponding to the non-humidifying period are correction numbers that are determined assuming that the divergence and convergence are not caused in the air flow near the air supply opening 51*a* and the air discharge opening 51*b*. That is, these correction numbers are determined assuming that the air flow has uniform distribution in the sub-scanning direction in the entire ejection space S1. Here, in a case where the humidifying period is one hour, and the non-humidifying period is ten hours, the period additive ejection numbers respectively corresponding to the ejection-opening groups U are those in FIG. 8D. For example, the period additive ejection number for the ejection-opening group U1 is 3120 (=120×1+300×10).

The additive-correction-amount determination section 157*b* then refers to the non-opposed ejection-opening area storage section 159 to determine subtractive ejection numbers in the flushing respectively for the period additive ejection numbers. In the present embodiment, each of the subtractive ejection numbers is determined based on the amount of the ink ejected in the most-recent image recording in a case where all of the discharge-side ejection-opening group(s) and the supply-side ejection-opening group(s) are non-opposed ejection-opening groups Ub or in a case where each of the discharge-side ejection-opening group(s) and the supply-side ejection-opening group(s) contains at least one opposed ejection-opening group Ua. In the other cases, each subtractive ejection number is determined at zero. That is, in the before-use flushing, more ink is always discharged from each of the discharge-side ejection-opening group and the supply-side ejection-opening group than from each of the other ejection-opening group(s) U.

Here, it is assumed that the ejection characteristics are recovered in ejection openings 108 used in the ejection of the ink in the image recording. Thus, in a certain ejection opening 108, the increase in viscosity of the ink after the capping is less in a case where the ejection opening 108 is opposed to the sheet P in the image recording before the capping than in a case where the ejection opening 108 is not opposed to the sheet P in the image recording before the capping. Thus, in the present embodiment, the additive-correction-amount determination section 157*b* determines the non-opposed ejection-opening group or groups Ub that are located in an area of the ejection opening region NA which is not opposed to the sheet P and from which no ink is ejected in the image recording before the capping. The additive-correction-amount determination section 157*b* then determines an opposed ejection-opening group or groups Ua that are located in an area of the ejection opening region NA which is opposed to the sheet P and from which the ink is ejected in the image recording before the capping. For example, in a case where the sheet P having the size illustrated in FIG. 5 is used for the image recording before the capping, the ejection-opening groups U3-U7 are determined as the opposed ejection-opening groups Ua, and the ejection-opening groups U1, U2, U8 are determined as the non-opposed ejection-opening groups Ub. The additive-correction-amount determination section 157*b* then determines the subtractive ejection numbers for the respective opposed ejection-opening groups Ua as a set specific ejection number (1000 in the present embodiment) and determines the subtractive ejection numbers for the respective non-opposed ejection-opening group Ub as zero. As a result, it is possible to further reduce the flushing amount in the before-use flushing.

The additive-correction-amount determination section 157*b* executes the additive correction by adding the additive correction numbers (see FIG. 8E) obtained by subtracting the subtractive ejection numbers from the respective period additive ejection numbers, to the reference ejection number stored in the flushing-amount storage section 156. It is noted that when a value obtained by subtracting the subtractive ejection number from the period additive ejection number is a negative value, the additive correction number is determined as zero. In the conventional setting of the flushing amounts, each of the additive correction numbers for the respective ejection-opening groups U is equal to the number of ejections for the ejection-opening group U1 that requires the largest number of ejections. Thus, the total ejection number as the sum of the additive correction numbers for the respective ejection-opening groups U is 24960 (=3120×8). In the present embodiment, on the other hand, where only the period correction is used, the total ejection number is 16260. Also, where the correction related to whether each group is opposed to the sheet P or not in the image recording is used, the total ejection number is 11260. In any case, the flushing amount is reduced. FIG. 8F represents the number of ejections in flushing stored in the flushing-amount storage section 156 after the additive correction executed by the additive-correction-amount determination section 157*b*.

Figure 10:
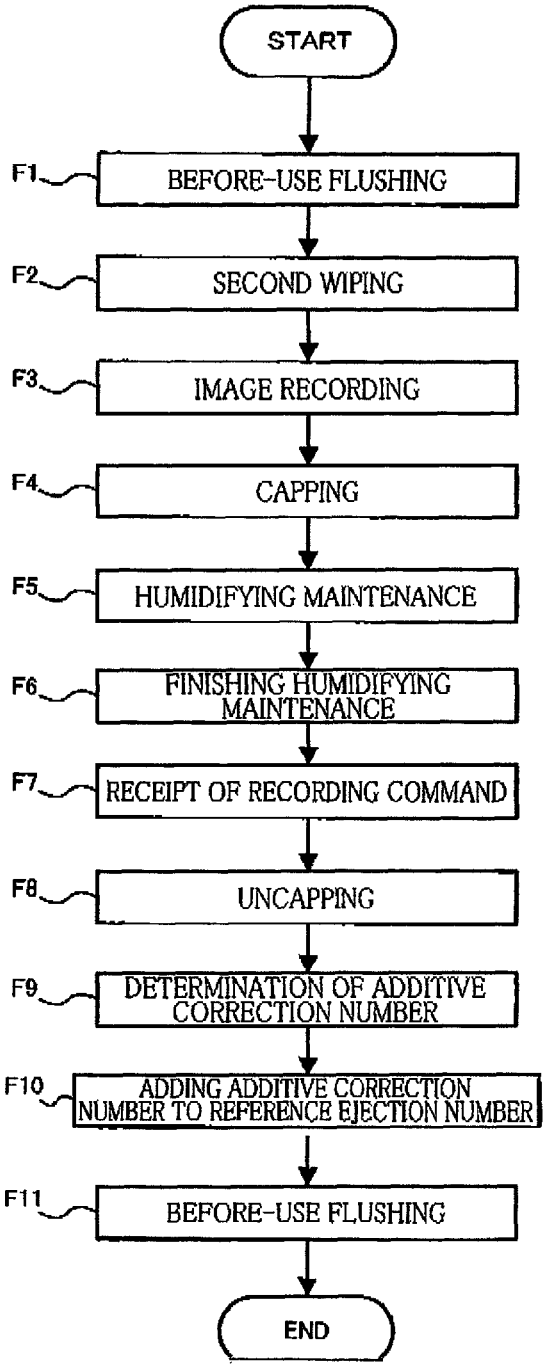
FIG. 10 is an operation flow for before-use flushing controlled by the control device in FIG. 1.

There will be next explained, with reference to FIG. 10, one example of operations of the printer 101 which relate to the before-use flushing. The operation flow in FIG. 10 represents a series of operations of the printer 101 from the before-use flushing to the next before-use flushing. Also, the start of this operation flow is after the humidifying maintenance and just before the image recording based on the recording command received from the external device (that is, just before the before-use flushing). That is, the platens 6*a*, 6*b* are located at the open position, the facing member 10 is located at the first position, and the head 1 is located at the recording position.

The flushing control section 155 initially controls the head 1 to perform the before-use flushing based on the number of ejections in flushing stored in the flushing-amount storage section 156 (F1).

The maintenance control section 154 controls the head elevating and lowering mechanism 30 and the facing-member elevating and lowering mechanism 49 to move the head 1 to the separated position and move the facing member 10 to the second position. The maintenance control section 154 then controls, as shown in FIG. 3C, the wiper mechanism 70 (specifically, the wiper moving mechanism 75) to move the wiper 71*b* to wipe the face 10*a* of the facing member 10 (F2: second wiping). The maintenance control section 154 then controls the facing-member elevating and lowering mechanism 49 and the wiper mechanism 70 to move the facing member 10 to the fourth position and return the base portion 71*c* (i.e., the wipers 71*a*, 71*b*) to the wait position. The maintenance control section 154 then controls the head elevating and lowering mechanism 30 and the support portion 6 to move the head 1 to the recording position and move the platens 6*a*, 6*b* to the support-face forming position.

The conveyance control section 151 then controls the guide mechanism 8 and the sheet-supply unit 101*c* to convey the sheet P, and the head control section 153 controls the head 1 to eject the ink based on the image data. The flushing control section 155 also controls the head 1 to eject the ink based on the flushing data (F3: image recording). In this image recording, the non-opposed ejection-opening area storage section 159 stores the area of the ejection opening region NA which is opposed to the sheet P and from which the ink is ejected.

Upon completion of the image recording, the maintenance control section 154 controls the facing-member elevating and lowering mechanism 49 and the support portion 6 to move the platens 6*a*, 6*b* to the open position and move the facing member 10 to the first position. The maintenance control section 154 then controls the cap elevating and lowering mechanism 48 to move the cap member 41 to the contact position as shown in FIG. 6. As a result, the ejection space S1 is changed to the sealing state in which the ejection space S1 is isolated from the outside space S2 (F4).

The maintenance control section 154 then drives the humidification pump 56. That is, the humid air is supplied from the air supply opening 51*a* into the ejection space S1, then delivered toward the air discharge opening 51*b*, and discharged from the air discharge opening 51*b* (F5: humidifying maintenance). As a result, the ink in the ejection openings 108 is replenished with water. The flow of the humid air in this humidifying maintenance moves the ink remaining on the cap member 41 toward the air discharge opening 51*b*. When a set specified time has elapsed from the driving of the humidification pump 56, the maintenance control section 154 stops driving the humidification pump 56 (F6).

When the control device 100 receives the recording command from the external device (F7), the maintenance control section 154 controls the cap elevating and lowering mechanism 48 to move the cap member 41 to the distant position as shown in FIG. 7. Thus, the ejection space S1 is changed to the open state in which the ejection space S1 is open to the outside space S2 (F8: uncapping).

The flushing-amount correcting section 157 then determines the additive correction numbers on the basis of the humidifying period and the non-humidifying period in the capping and the ink ejection in the most-recent image recording (F9), and executes the additive correction by adding the determined additive correction numbers to the reference ejection number stored in the flushing-amount storage section 156 (F10).

The flushing executing section 158 then controls the head 1 to perform the before-use flushing based on the number of ejections in flushing stored in the flushing-amount storage section 156 (F11). In this operation, the flushing-amount storage section 156 initializes the number of ejections in flushing to the reference ejection number, and the operations of the printer 101 which relate to the before-use flushing are finished.

As described above, the printer 101 as the present embodiment includes the flushing control section 155 configured to control the head 1 to perform the flushing by ejecting the liquid from the plurality of ejection openings 108 after the sealing state and before the image recording, and where the plurality of ejection openings 108 are divided into the plurality of ejection-opening groups each constituted by at least one of the plurality of ejection openings 108, in the direction directed from the air supply opening 51*a* toward the air discharge opening 51*b*, the flushing control section 155 is configured to control the head 1 to perform the before-use flushing such that an amount of the ink discharged from each of the ejection-opening groups U containing at least one of the plurality of ejection openings 108 which is located within the first distance and the second distance is greater than an amount of the ink discharged from each of the other ejection-opening groups U and such that the amount of the ink discharged from each of the ejection-opening group(s) U containing at least one of the plurality of ejection openings 108 which is located within the first distance is greater than the amount of the ink discharged from each of the ejection-opening group(s) U containing at least one of the plurality of ejection openings 108 which is located within the second distance. This flushing control section 155 may be configured to control the head 1 to perform the before-use flushing such that the amount of the ink discharged from each of at least one of the plurality of ejection openings 108 which is located within the first distance and the second distance is greater than the amount of the ink discharged from each of the other ejection openings 108 and such that the amount of the ink discharged from each of at least one of the plurality of ejection openings 108 which is located within the first distance is greater than the amount of the ink discharged from each of at least one of the plurality of ejection openings 108 which is located within the second distance. In this configuration, the flushing control section 155 may control the head 1 to perform the before-use flushing such that the amount of the ink discharged from the ejection opening 108 increases with decrease in distance from the air discharge opening 51*b* or the air supply opening 51*a*.

Also, when the head 1 is not used, the printer 101 according to the present embodiment performs the humidifying maintenance by supplying the humid air from the air supply opening 51*a* into the ejection space S1 being in the sealing state to humidify the ejection space S1 in order to prevent clogging of the ejection openings 108. In addition, when starting the image recording after the capping, the printer 101 performs the before-use flushing by discharging the ink from the ejection openings 108. The additive correction numbers for the humidifying period which are added to the reference ejection number in the before-use flushing are determined such that the additive correction amount for one of each two of the ejection-opening groups U which is near to the air supply opening 51*a* is less than the additive correction amount for another of the each two of the ejection-opening groups which is far from the air supply opening 51*a*. This configuration can reduce the flushing amount consumed in the before-use flushing.

Also, the additive correction number for the flushing in the non-humidifying period is determined to be large for the ejection-opening group(s) U near the air supply opening 51*a* and the ejection-opening group(s) U near the air discharge opening 51*b* than for the other ejection-opening group(s) U. This makes it possible to recover the ejection characteristics according to the humidity distribution in the ejection space S1 in the non-humidifying period.

Also, the additive correction number is determined to be small for each of the opposed ejection-opening groups Ua constituted by only the ejection openings 108 from which the ink is ejected in the image recording before the capping. This configuration further reduces the flushing amount consumed in the before-use flushing.

Also, the additive correction number for the humidifying period is determined to be large for the ejection-opening groups U1, U8 respectively near the air supply opening 51*a* and the air discharge opening 51*b*. Thus, the ejection characteristics can be reliably recovered for the ejection openings 108 in which the drying degree per unit time is considerably large due to insufficient contact of the ink with the humid air in the humidifying maintenance.

While the embodiment of the present invention has been described above, it is to be understood that the invention is not limited to the details of the illustrated embodiment, but may be embodied with various changes and modifications, which may occur to those skilled in the art, without departing from the spirit and scope of the invention. For example, while the humidifying maintenance is performed in each capping in the above-described embodiment, the humidifying maintenance may not be performed in each capping. Also, the humidifying maintenance may be intermittently performed in the capping, that is, the humidification pump 56 may be intermittently driven in the capping. Also, the humidifying maintenance may be performed over the entire period of the capping.

Also, the additive correction number for the flushing in the humidifying period is a positive value in the above-described embodiment. Nevertheless, in a case where the increase in viscosity of the ink in the ejection openings 108 can be recovered by the humidifying maintenance (e.g., the second or subsequent humidifying maintenance after at least one non-humidifying period), zero or a negative number may be added to the additive correction numbers for such a humidifying maintenance.

Also, while the reference ejection number for flushing which is stored in the flushing-amount storage section 156 is fixed in the above-described embodiment, the present invention is not limited to this configuration. For example, the reference ejection number may vary among the ejection-opening groups U. Alternatively, the reference ejection number may be zero.

Also, the capping mechanism 40 may have any structure as long as the capping mechanism 40 can take the sealing state in which the ejection space S1 is isolated from the outside space S2 and the open state in which the ejection space S1 is open to the outside space S2. For example, while the distal end 41*a* of the cap member 41 is movable upward and downward in the above-described embodiment, the capping mechanism 40 may be designed such that the distal end 41*a* of the cap member 41 is immovably fixed to the head holder 13, and the position of the distal end 41*a* oldie cap member 41 relative to the ejection face 1*a* is fixed. In this case, the capping mechanism 40 only needs to be configured such that the distal end 41*a* of the cap member 41 can contact the facing member 10 when the facing member 10 is located at the first position.

Also, the shape and position of each of the air supply opening 51*a* and the air discharge opening 51*b* are not limited in particular as long as the openings 51*a*, 51*b* communicate with the ejection space S1 and arranged such that the ejection opening region NA is interposed between the openings 51*a*, 51*b* when seen in the direction perpendicular to the ejection face 1*a*. For example, the air supply opening 51*a* and the air discharge opening 51*b* are arranged such that the ejection opening region NA is interposed between the openings 51*a*, 51*b* in the conveying direction D when seen in the direction perpendicular to the ejection face 1*a*. Also, the printer 101 may be configured such that the air supply opening 51*a* is formed in the ejection face 1*a*, and the air discharge opening 51*b* is formed in the face 10*a* of the facing member 10.

Also, the width of each of the air supply opening 51*a* and the air discharge opening 51*b* in the sub-scanning direction may be equal to or longer than the width of the ejection opening region NA in the sub-scanning direction. In this case, the distance of the flow of the humid air in the conveying direction D is equal to or longer than the width of the ejection opening region NA in the conveying direction D (i.e., the sub-scanning direction) at both of the area near the air supply opening 51*a* and the area near the air discharge opening 51*b* in the ejection space S1, thereby preventing the distance of the flow of the humid air from producing ejection openings 108 in which the increase in viscosity of the ink is considerably different from that in other ejection openings 108. Thus, in this case, the effect of the flow path of the humid air is not used for the additive correction number for the humidifying period. Accordingly, the additive correction number for the ejection-opening group U in the humidifying period decreases with decrease in distance from the air supply opening 51*a*, so that the additive correction number for the ejection-opening group U8 is less than that for the ejection-opening group U7.

Also, among any adjacent two of the ejection-opening groups U in the above-described embodiment, as shown in FIG. 8B, the additive correction number for the number of ejections in flushing in the humidifying period is basically less in one of the adjacent two ejection-opening groups U which is nearer to the air supply opening 51*a*, than the other of the adjacent two ejection-opening groups U. Nevertheless, as long as the additive correction number for the ejection-opening group U8 that is the nearest to the air supply opening 51*a* among the ejection-opening groups U1-U8 is set to be less than that for the ejection-opening group U1 that is the farthest from the air supply opening 51*a* among the ejection-opening groups U1-U8, the same additive correction number may be set for the adjacent two of the ejection-opening groups U, e.g., the ejection-opening group U4 and the ejection-opening group U5.

Also, the addition related to whether each group is opposed to the sheet P or not in the image recording is used for the number of ejections in flushing in the above-described embodiment but may not be used. For example, the addition related to whether each group is opposed to the sheet P or not in the image recording may not be used in a case where the capping is performed over a long period.

Also, while each of the ejection-opening groups U is constituted by a plurality of the ejection openings 108 corresponding to one of the actuator units 21 in the above-described embodiment, the present invention is not limited to this configuration. For example, each of the ejection-opening groups U may be constituted by a corresponding one of the ejection openings 108. In this case, the flushing amount is adjusted for each of the ejection openings 108, making it possible to further reduce the amount of the ink consumed in the before-use flushing.

Also, while the center of the sheet P in the main scanning in the image recording is positioned by the pair of sheet positioning walls 35*a* of the sheet-supply unit 101*c* in the above-described embodiment, the present invention is not limited to this configuration. For example, the printer 101 may be designed such that the guide mechanism 8 includes: a guide wall extending along the sheet conveyance path and designed to position one side of the sheet in the conveyance perpendicular direction; and a skew roller for conveying the sheet P toward the head 1 while skewing the sheet P toward the guide wall, and the guide wall and the skew roller position the sheet P in the main scanning direction. In this case, the guide wall only needs to be moved in the conveyance perpendicular direction according to the size of the sheet P such that the center of the sheet P in the main scanning direction is located within the central region NAC of the ejection opening region NA and opposed to the position located nearer to the air supply opening 51*a* than the center F when seen in the direction perpendicular to the ejection face 1*a*.

Also, the width of the ejection opening region NA in the main scanning direction may be equal to the width of the sheet P in the main scanning direction which width is the largest among the sheets P that can be accommodated in the sheet-supply tray 35.

Also, while the capping mechanism 40 is designed such that the cap member 41 is fixed to the head 1 in the above-described embodiment, the present invention is not limited to this design. The cap member may be fixed to the facing member. For example, an elastic lip is provided upright on a periphery of the facing member. The lip can be moved relative to the head 1, so that at their contact position, a distal end of the lip is held in contact with a peripheral portion of the ejection face 1*a* to establish a sealing state, and at their distant position, the lip and the facing member are separated from the ejection face 1*a* to establish an open state. In this design, the air supply opening and the air discharge opening may be formed in the ejection face 1*a* (or the ejection-face side) and may be formed in the cap member, i.e., the facing member (or the cap-member side). Also, the air supply opening and the air discharge opening may be formed such that one of them is formed in the ejection-face side while the other of them is formed in the cap-member side.

The present invention is also applicable to a line printer and a serial printer and applicable not only to the printer but also to devices such as a facsimile machine and a copying machine. Also, the present invention is applicable to a liquid ejection apparatus configured to eject liquid other than the ink to perform the recording. The recording medium is not limited to the sheet P, and various recordable media may be used. The present invention may be applied to a liquid ejection apparatus of any ink ejection method. For example, the piezoelectric elements are used in the present embodiment, but various methods may be used such as a resistance heating method and an electrostatic capacity method.

What is claimed is:

1. A liquid ejection apparatus, comprising:

a head comprising an ejection face that comprises an ejection opening region having a plurality of ejection-opening groups each having at least one ejection opening through which the head ejects liquid to record an image on a recording medium, the ejection opening region having a plurality of ejection openings constituted by the plurality of ejection-opening groups;

a capping unit configured to selectively establish one of: a sealing state in which an ejection space opposed to the ejection face is isolated from an outside space; and an open state in which the ejection space is open to the outside space;

an air supply opening and an air discharge opening communicating with the ejection space in the sealing state and arranged such that the ejection opening region is interposed between the air supply opening and the air discharge opening when seen in a direction perpendicular to the ejection face;

a humidification unit configured to perform a humidifying maintenance in the sealing state by supplying humid air into the ejection space via the air supply opening and by discharging air from the ejection space via the air discharge opening;

a recording control unit configured to control the head to perform image recording by ejecting the liquid from at least one of the plurality of ejection openings which is opposed to the recording medium; and a flushing control unit configured to control the head to perform flushing by ejecting the liquid from at least one of the plurality of ejection openings after the sealing state and before the image recording, wherein the plurality of ejection-opening groups are arranged in a first direction directed from the air supply opening toward the air discharge opening, wherein the plurality of election-opening groups comprise:

a center-positioned ejection-opening group which is nearer to a center of the ejection opening region than the other groups of the plurality of ejection-opening groups in the first direction;

a discharge-side ejection-opening group which is nearer to the air discharge opening than the center-positioned ejection-opening in the first direction; and a supply-side ejection-opening group which is nearer to the air supply opening than the center-positioned ejection-opening group in the first direction, and wherein the flushing control unit is configured to control the head to perform the flushing such that each of an amount of the liquid discharged from each of the at least one ejection opening belonging to the discharge-side ejection-opening group and an amount of the liquid discharged from each of the at least one ejection openings belonging to the supply-side ejection-opening group is greater than an amount of the liquid discharged from each of the at least one ejection openings belonging to the center-positioned ejection-opening group.

2. The liquid ejection apparatus according to claim 1, wherein the flushing control unit is configured to control the head to perform the flushing such that the amount of the liquid discharged from each of the at least one ejection openings belonging to the discharge-side ejection-opening group is greater than the amount of the liquid discharged from each of the at least one ejection openings belonging to the supply-side ejection-opening group.

3. The liquid election apparatus according to claim 1, wherein the flushing control unit is configured to control the head to perform the flushing such that a difference between each of the amount of the liquid discharged from each of the at least one discharge openings belonging to the discharge-side ejection-opening group and the amount of the liquid discharged from each of the at least one ejections opening belonging to the supply-side ejection-opening group and the amount of the liquid discharged from each of the at least one ejection openings belonging to the center-positioned ejection-opening group increases with an increase in a non-humidifying period in which the humidifying maintenance is not performed in the sealing state.

4. The liquid ejection apparatus according to claim 1, wherein in a case where each of all of the discharge-side ejection-opening group and the supply-side election opening group is a non-opposed ejection-opening group containing at least one of the plurality of ejection openings which is not opposed to the recording medium and not used for the ejection of the liquid in the image recording before the sealing state or in a case where each of the discharge-side ejection-opening group and the supply-side ejection-opening group contains at least one opposed ejection-opening group each containing only at least one of the plurality of ejection openings which is opposed to the recording medium and used for the ejection of the liquid in the image recording before the sealing state, the flushing control unit controls the head to perform the flushing such that an amount of the liquid discharged from each of the at least one ejection openings belonging to a certain one of the plurality of ejection-opening groups is less in a case where the certain one of the plurality of ejection-opening groups is one of the at least one opposed ejection-opening group than in a case where the certain one of the plurality of ejection-opening groups is the non-opposed ejection-opening group.

5. The liquid election apparatus according to claim 1, wherein the flushing control unit comprises:

a liquid-discharge-amount storage device configured to store, for each of the plurality of ejection openings, a liquid discharge amount that is an amount of the liquid discharged in the flushing;

a liquid-discharge-amount correcting unit configured to correct the liquid discharge amount stored in the liquid-discharge-amount storage device; and a flushing executing unit configured to control the head to perform the flushing based on the liquid discharge amount stored in the liquid-discharge-amount storage device, wherein the liquid-discharge-amount correcting unit is configured to execute the additive correction for the liquid discharge amount stored in the liquid-discharge-amount storage device, based on a non-humidifying period that is a period in which the humidifying maintenance is not performed in the sealing state, and wherein the liquid-discharge-amount correcting unit is configured to determine an additive correction amount to be added to the liquid discharge amount for the non-humidifying period, such that each of a first additive correction amount to be added to the liquid discharge amount for each of the at least one ejection openings belonging to the supply-side ejection-opening group and a second additive correction amount to be added to the liquid discharge amount for each of the at least one ejection openings belonging to the discharge-side ejection-opening group is greater than a third additive correction amount to be added to the liquid discharge amount for each of the at least one ejection opening belonging to the center-positioned ejection-opening group.

6. The liquid ejection apparatus according to claim 5, wherein the second additive correction amount is greater than the first additive correction amount.

7. The liquid ejection apparatus according to claim 1, wherein the flushing control unit comprises:

a liquid-discharge-amount storage device configured to store, for each of the plurality of ejection openings, a liquid discharge amount that is an amount of the liquid discharged in the flushing;

a liquid-discharge-amount correcting unit configured to correct the liquid discharge amount stored in the liquid-discharge-amount storage device; and a flushing executing unit configured to control the head to perform the flushing based on the liquid discharge amount stored in the liquid-discharge-amount storage device, wherein the liquid-discharge-amount correcting unit is configured to execute the additive correction for the liquid discharge amount stored in the liquid-discharge-amount storage device, based on a humidifying period that is a period in which the humidifying maintenance is performed in the sealing state, and wherein the liquid-discharge-amount correcting unit is configured to determine an additive correction amount to be added to the liquid discharge amount for the humidifying period, such that the additive correction amount for each of the at least one ejection opening belonging to one of each two of the plurality of ejection-opening groups which is near to the air supply opening is less than the additive correction amount for each of the at least one ejection opening belong to another of said each two of the plurality of ejection-opening groups which is far from the air supply opening.

8. The liquid ejection apparatus according to claim 5, wherein the air supply opening is less in length than the ejection opening region is a direction perpendicular to the first direction, and wherein the liquid-discharge-amount correcting unit is configured to add a set specific amount to the additive correction amount for each of the plurality of ejection openings in one of the plurality of ejection-opening groups which one is located within a predetermined distance from the air supply opening.

9. The liquid ejection apparatus according to claim 5, wherein in a case where each of all of the discharge-side ejection-opening group and the supply-side ejection-opening group is a non-opposed ejection-opening group containing at least one of the plurality of ejection openings which is not opposed to the recording medium and not used for the ejection of the liquid in the image recording before the sealing state or in a case where each of the discharge-side ejection-opening group and the supply-side ejection-opening group contains at least one opposed ejection-opening group each containing only at least one of the plurality of ejection openings which is opposed to the recording medium and used for the ejection of the liquid in the image recording before the scaling state, the liquid-discharge-amount correcting unit, when the opposed ejection-opening group is present in the image recording before the sealing state, corrects, for each of at least one of the plurality of election openings in the opposed ejection-opening group, the additive correction amount by reducing a set specific amount from the additive correction amount.

10. The liquid ejection apparatus according to claim 1, further comprising a conveyor mechanism configured to convey the recording medium in a conveying direction to an area opposed to the ejection face, wherein the air supply opening and the air discharge opening are arranged such that the ejection opening region is interposed between the air supply opening and the air discharge opening in a conveyance perpendicular direction as the first direction perpendicular to the conveying direction, when seen in the direction perpendicular to the ejection face.

11. The liquid ejection apparatus according to claim 10, wherein a midpoint between the air supply opening and the air discharge opening in the conveyance perpendicular direction is located on a central region of the ejection opening region in the conveyance perpendicular direction, wherein a length of the ejection opening region of the head is greater than a width of the recording medium in the conveyance perpendicular direction, wherein the conveyor mechanism is configured to convey the recording medium in the image recording such that the recording medium avoids an area within a first avoidance distance from the air discharge opening in the conveyance perpendicular direction and an area within a second avoidance distance from the air supply opening in the conveyance perpendicular direction, and wherein a sum of the first avoidance distance and the second avoidance distance is greater than a value obtained by subtracting a length of the ejection opening region in the conveyance perpendicular direction from a separation distance between the air supply opening and the air discharge opening in the conveyance perpendicular direction and equal to or less than a value obtained by subtracting the width of the recording medium in the conveyance perpendicular direction from the separation distance.

12. The liquid ejection apparatus according to claim 11, wherein the conveyor mechanism is configured to convey the recording medium in the image recording such that the central region of the ejection opening region is opposed to a central position of the recording medium in the conveyance perpendicular direction when seen in the direction perpendicular to the ejection face.

13. The liquid ejection apparatus according to claim 12, wherein the conveyor mechanism is configured to convey the recording medium n the image recording such that a distance between the central position of the recording medium in the conveyance perpendicular direction and the air supply opening is less than a distance between a central position of the central region of the ejection opening region in the conveyance perpendicular direction and the air supply opening when seen in the direction perpendicular to the ejection face.

14. The liquid ejection apparatus according to claim 1, wherein the capping unit comprises:

a cap member configured to enclose the head;

a facing member provided facing the ejection face with the ejection space therebetween; and a cap-member moving mechanism configured to move the cap member between a contact position at which the cap member contacts the facing member and a distant position at which the cap member is distant from the facing member.

15. The liquid ejection apparatus according to claim 1, wherein each of the plurality of ejection-opening groups is constituted by a corresponding one of the plurality of ejection openings.

* * * * *